US007528099B2

(12) United States Patent
Wahl et al.

(10) Patent No.: US 7,528,099 B2
(45) Date of Patent: May 5, 2009

(54) FABRIC CARE COMPOSITION

(75) Inventors: Errol Hoffman Wahl, Cincinnati, OH (US); Jodi Lee Brown, Cincinnati, OH (US); Lisa Grace Brush, Cincinnati, OH (US); Ruth Anne Wagers, Middletown, OH (US); George Endel Deckner, Cincinnati, OH (US); Eric Scott Johnson, Hamilton, OH (US); Barbara Kay Williams, West Chester, OH (US); Jiping Wang, West Chester, OH (US); Jean-Pol Boutique, Gembloux (BE); Patrick Firmin August Deplancke, Laarne (BE); Francesco de Buzzaccarini, Breedonk (BE); Michele Ann Watkins, Milford, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 230 days.

(21) Appl. No.: 11/643,236

(22) Filed: Dec. 21, 2006

(65) Prior Publication Data

US 2007/0105739 A1 May 10, 2007

Related U.S. Application Data

(63) Continuation of application No. 11/356,269, filed on Feb. 16, 2006.

(60) Provisional application No. 60/653,897, filed on Feb. 17, 2005.

(51) Int. Cl.
*C11D 17/08* (2006.01)

(52) U.S. Cl. ..... 510/295; 510/296; 510/349; 510/438

(58) Field of Classification Search ..... 510/295, 510/296, 349, 438
See application file for complete search history.

(56) References Cited

U.S. PATENT DOCUMENTS

2004/0092425 A1 5/2004 Boutique et al.

FOREIGN PATENT DOCUMENTS

WO WO 01/60966 * 8/2001
WO WO 2005/017085 A1 2/2005

* cited by examiner

*Primary Examiner*—John R Hardee
(74) *Attorney, Agent, or Firm*—Ronald T. Sia; Kim W. Zerby

(57) ABSTRACT

The articles, compositions, and kits of the present invention are useful for conditioning fabric.

13 Claims, No Drawings

FABRIC CARE COMPOSITION

CROSS REFERENCE

This application is a continuation of pending U.S. patent application Ser. No. 11/356,269, filed Feb. 16, 2006 (now Publication No. US-2006-0217288 A1, published Sep. 28, 2006) which claims the benefit of U.S. Provisional Application Ser. No. 60/653,897, filed Feb. 17, 2005, the disclosure of which is incorporated herein by reference.

FIELD OF INVENTION

The present invention relates to fabric care compositions and methods of using the same.

BACKGROUND OF THE INVENTION

Conventional fabric softening compositions are added in the rinse cycle of the laundering process to soften fabrics or as dryer added softener sheets to a machine dryer. However, adding such compositions during the rinse cycle can be inconvenient for the consumer, unless the consumer has a laundry washing machine that has a built-in fabric softener dispensing unit, a removable agitator post-mounted fabric softener dispenser, or has a fabric softener dosing device such as the DOWNY® Ball. Otherwise, the consumer has to monitor the laundering process and then manually add the fabric softener to the load as soon as the rinse cycle begins.

Softening-through-the-wash compositions (hereinafter referred to as "STW" compositions) are able to soften fabrics, and provide other conditioning benefits to fabrics while being added to the fabrics in the laundering process during the washing stage, negating the need to add a separate fabric conditioning composition to the rinse stage and/or drying stage of the laundering process. The STW compositions can thus be added to the load of laundry at the beginning of the laundering process, which provides the consumer with an efficient and easy way to soften and freshen fabrics during the laundering process.

It is convenient to provide fabric softening compositions in the form of a unit dose. Previous attempts have been made to provide a unit dose fabric softening composition in the form of a tablet. However, such tablets can tend to leave an undesirable visible residue on the treated fabrics, are suitable only for addition in the rinse cycle, and/or provide only insignificant fabric softening benefits. See, e.g., U.S. Pat No. 6,291,421 and U.S. Pat No. 6,110,886. Recent progress has been claimed for STW tablets. See, e.g., WO 04/111167A1. However, there is a growing preference by the consumer for liquid STW products, especially in a unitized dose form.

Thus the need still exists to provide improved softening-through-the-wash compositions that provide effective deposition of a fabric softening active on the treated fabrics to provide the consumer a noticeable softening benefit, while avoiding the deposition of a visible residue on the treated fabrics.

SUMMARY OF THE INVENTION

The present invention attempts to address these and other needs. A first aspect of the invention provides an article of manufacture comprising a compartment, a composition, and a water soluble film; wherein the composition comprises a unit dose of a fabric softening active and a coacervate; wherein the unit dose of coacervate comprises achieving from about 1 parts per million ("ppm") to about 25 ppm of the coacervate if the article is administered in a 64 liter basin of an automatic washing machine of water;

wherein the ppm amount of the coacervate does not include water that may or may not be associated with the coacervate; and wherein the water soluble film encapsulates the composition to form the compartment.

A second aspect of the invention provides an article of manufacture comprising a compartment, a composition, and a water soluble film; wherein the composition comprises a coavervate and a fabric care active, wherein the coacervate comprises from about 0.1% to about 10% by weight of the composition, and wherein the weight percentage does not include water that may or may not be associated with the coacervate; wherein the coacervate is comprised of a cationic polymer chosen from a cationic guar gum, a cationic cellulose polymer, or a combination thereof, wherein the fabric care active comprising a silicone; wherein the silicone comprises from about 2% to about 90% by weight of the composition; wherein the silicone comprises a viscosity from about 10,000 cSt to about 600,000 cSt; and wherein the water soluble film encapsulates the composition to form the compartment.

Methods of using the article and compositions to treat fabric also provided.

DETAILED DESCRIPTION OF THE INVENTION

The term "fabric care" is used herein the broadest sense to include any conditioning benefit(s) to fabric. One such conditioning benefit includes softening fabric. Other non-limiting conditioning benefits include reduction of abrasion, reduction of wrinkles, fabric feel, garment shape retention, garment shape recovery, elasticity benefits, ease of ironing, perfume, freshness, color care, color maintenance, whiteness maintenance, increased whiteness and brightness of fabrics, pilling reduction, static reduction, antibacterial properties, suds reduction (especially in high efficiency, horizontal axis washing machines), malodor control, or any combination thereof. One aspect of the invention provides a highly concentrated fabric care compositions suitable for dosing, for example, as a unit dose article. Another aspect of the invention provides for concentrated or non-concentrated fabric care compositions suitable for dosing, for example, from a container. In one embodiment, the composition is dispensed in the wash cycle of an automatic washing machine. In another embodiment, the composition is dispensed in the rinse cycle. In yet another embodiment, the composition is dispensed in a handwashing basin, in either the wash or a rinse cycle. In yet another embodiment, the composition is dispensed in a single, first handwashing basin.

A. Silicone

One aspect of invention comprises a fabric care composition comprising a silicone as a fabric care active. Silicone polymers, not only provide softness and smoothness to fabrics, but also provide a substantial color appearance benefit to fabrics, especially after multiple laundry washing cycles. While not wishing to be bound by theory, it is believed that silicone polymers provide an anti-abrasion benefit to fabrics in the washing or rinse cycles of an automatic washing machine by reducing friction of the fibers. Garments can look newer longer and can last longer before wearing out.

Levels of silicone will depend, in part, on whether the composition is concentrated or non-concentrated. Typical minimum levels of incorporation of silicone in the present compositions are at least about 1%, alternatively at least about 5%, alternatively at least about 10%, and alternatively at least about 12%, by weight of the fabric care composition; and the typical maximum levels of incorporation of silicone are less than about 90%, alternatively less than about 70%, by weight of the fabric care composition.

In one embodiment, the composition is a concentrated composition comprising from about 5% to about 90%, alternatively from about 8% to about 70%, alternatively about 9% to about 30%, alternatively from about 10% to 25%, alternatively from about 15% to about 24%, silicone by weight of the fabric care composition.

In another embodiment, the composition is a non-concentrated composition comprising from about 2% to about 30%, alternatively from about 3% to about 20%, alternatively 4% to about 10%, silicone by weight of the composition.

The silicone of the present invention can be any silicone comprising compound. In one embodiment, the silicone is a polydialkylsilicone, alternatively a polydimethyl silicone (polydimethyl siloxane or "PDMS"), or a derivative thereof. In another embodiment, the silicone is chosen from an aminofunctional silicone, alkyloxylated silicone, ethoxylated silicone, propoxylated silicone, ethoxylated/propoxylated silicone, quaternary silicone, or combinations thereof. Other useful silicone materials may include materials of the formula:

$$HO[Si(CH_3)_2—O]_x\{Si(OH)[(CH_2)_3—NH—(CH_2)_2—NH_2]O\}_y,H$$

wherein x and y are integers which depend on the molecular weight of the silicone, preferably has a molecular weight such that the silicone exhibits a viscosity of from about 500 cSt to about 500,000 cSt at 25° C. This material is also known as "amodimethicone". Although silicones with a high number of amine groups, e.g., greater than about 0.5 millimolar equivalent of amine groups can be used, they are not preferred because they can cause fabric yellowing.

In one embodiment, the silicone is one comprising a relatively high molecular weight. A suitable way to describe the molecular weight of a silicone includes describing its viscosity. A high molecular weight silicone is one having a viscosity of from about 1,000 cSt to about 3,000,000 cSt, preferably from about 6,000 cSt to about 1,000,000 cSt, alternatively about 7,000 cSt to about 1,000,000 cSt, alternatively 8,000 cSt to about 1,000,000 cSt, alternatively from about 10,000 cSt to about 600,000 cSt, alternatively from about 100,000 cSt to about 350,000 cSt. In yet another embodiment, the silicone is a PDMS or derivatives thereof, having a viscosity from about 60,000 cSt to about 600,000 cSt, alternatively from about 75,000 cSt to about 350,000 cSt, and alternatively at least about 100,000 cSt. One example of a PDMS is DC 200 fluid from Dow Corning. In yet another embodiment, the viscosity of the aminofunctional silicone can be low (e.g., from about 50 cSt to about 100,000 cSt).

For purposes of describing the present invention, any method can be used to measure the viscosity of the silicone. One suitable method is the "Cone/Plate Method" as described herein. The viscosity is measured by a cone/plate viscometer (such as Wells—Brookfield cone/plate viscometer by Brookfield Engineering Laboratories, Stoughton, Mass.). Using the Cone/Plate Method, the spindle is "CP-52" and the revolutions per minute (rpm) is set at 5. The viscosity measurement is conducted at 25° C. Under the Cone/Plate Method, a typical PDMS fluid measured at about 100,000 cSt will have an average molecular weight of about 139,000. Without wishing to be bound by theory, the high molecular weight silicone is more viscous and is less easily rinsed off of the fabrics in the washing and/or rinsing cycles of an automatic washing machine.

Another aspect of the invention provides a fabric care composition comprising a silicone emulsion. In one embodiment, the compositions of the present invention comprise a first phase, a second phase and an effective amount of an emulsifier such that the second phase forms discrete droplets in the continuous first phase. The second phase, or dispersed phase, comprises at least one fabric care active (such as a silicone). The dispersed phase may also contain other fabric are actives (such as, but not limited to, a static control agent and/or a perfume). Additionally, the first phase may also contain at least one fabric care active (such as a hueing dye). Alternatively, there may be several dispersed phases containing fabric care actives.

In one embodiment, if the fabric care active is a liquid, for example a silicone liquid, the second phase may form discrete droplets having a defined $\chi_{50}$. In turn, "$\chi_{50}$" is herein defined as the median diameter of a particle (measured in micrometers) on a volumetric basis. For example, if the $\chi_{50}$ is 1000 μm, then about 50% by volume of the particles are smaller than this diameter and about 50% are larger. In one embodiment, the droplets forming the second phase have a $\chi_{50}$ of less than about 1000 μm, alternatively less than about 500 μm, alternatively less than about 100 μm; alternatively at least about 0.1 μm, alternatively at least about 1 μm, alternatively at least about 2 μm For purposes of describing the present invention, any method can be used to measure the $\chi_{50}$ of the droplets comprising the second phase, for example laser light scattering using a Horiba LA900 Particle Size Analyzer. One suitable method is described by the International Standard test method ISO 13320-1:1999(E) for Particle Size Analysis—Laser Diffraction Methods.

While not wanting to be bound by theory, it is believed that silicone particles smaller that about 0.1 μm are too fine to be effectively trapped in the fabrics during the wash cycle and silicone particles larger than about 1000 μm provide poor distribution of active on fabric, resulting in less optimal benefits and even possible fabric spotting or staining. Alternatively, it is preferred to have the silicone particles from about 0.5 μm to about 50 μm. Most preferred are silicone particles from about 1 μm to about 30 μm in diameter. One aspect of the invention provides a fabric care composition comprising a PDMS and/or an aminofunctional silicone. For the aminofunctional silicone (also defined as "aminosilicone"), it is preferred to have a viscosity of from about 50 cSt to about 1,500,000 cSt, preferably from about 100 cSt to about 1,000,000 cSt, alternatively about 500 cSt to about 500,000 cSt, alternatively 1,000 cSt to about 350,000 cSt, alternatively from about 1,500 cSt to about 100,000 cSt. In one embodiment, the PDMS and aminofunctional silicone are combined. It is preferred that the viscosity of a combination of PDMS and aminofunctional silicone be from about 500 cSt to about 100,000 cSt. For example, improved fabric care benefits may be achieved by combining the PDMS to aminofunctional silicone in a ratio from about 6:1 to about 1:3, alternatively from about 5:1 to about 1:1, alternatively from about 4:1 to about 2:1, respectively. In another embodiment, the PDMS to aminofunctional silicone ratio is combined in about 3:1 ratio before being incorporated as part of the fabric care composition.

One aspect of this invention is based upon the surprising discovery that high molecular weight PDMS, verses low molecular weight PDMS, may be more effective in softening fabric though the wash. However, high molecular weight PDMS is viscous and thus difficult to handle from a processing perspective. Adding the viscous PDMS and an emulsifier into the composition can result in inhomogeneous mixing of the ingredients. Surprisingly, by using a high internal phase emulsion ("HIPE") as a premix, processing advantages are achieved. That is, by premixing a silicone, such as PDMS, and the emulsifier to create a HIPE, then mixing this HIPE into the composition, good mixing may be achieved thereby resulting in a homogeneous mixture. Net, a composition that exhibits good fabric benefits can be achieved.

HIPEs generally are comprised of at least about 65%, alternatively at least about 70%, alternatively at least about 74%, alternatively at least about 80%; alternatively not greater than about 95%, by weight of an internal phase (dispersed phase), wherein the internal phase comprises a silicone. The internal phase can also be other water insoluble fabric care benefit agents that are not already pre-emulsified. Pre-emulsified water insoluble fabric care benefit agents, for example, as discussed in the next section entitled "Other Water Insoluble Fabric Care Benefit Agents", can be used without the need to form a HIPE. The internal phase is dispersed by using an emulsifying agent. Examples of the emulsifying agent include a surfactant or a surface tension reducing polymer. In one embodiment, the range of the emulsifying agent is from at least about 0.1% to about 25%, alternatively from about 1% to about 10%, and alternatively from about 2% to about 6% by weight of the HIPE. In another embodiment, the emulsifying agent is water soluble and reduces the surface tension of water, at a concentration less than of 0.1% by weight of deionized water, less than about 70 dynes, alternatively less than about 60 dynes, alternatively less than about 50 dynes; alternatively at or greater than about 20 dynes. In another embodiment, the emulsifying agent is at least partially water insoluble.

The external phase (continuous phase), in one embodiment, is water, alternatively comprises at least some water, alternatively comprises little or no water. In another embodiment, the external phase of water comprises from less than about 35%, alternatively less than about 30%, alternatively less than about 25%; alternatively at least about 1%, by weight of HIPE. Non-aqueous HIPEs can be prepared as well with a solvent as the external phase with low or no water present. Typical solvents include glycerin and propylene glycol. Other solvents are listed in the "Solvents" section of the present disclosure.

HIPEs are prepared by first combining the oil phase (internal phase) and the emulsifying agent. Then the external phase (e.g., water or solvent or a mixture thereof) is added slowly with moderate mixing to the combination of the oil phase and the emulsifying agent. As a general principle, the thinner (i.e., less viscous) the oil phase, the more important it is to add the external phase (e.g., water) slowly. At least one way to test the quality of the HIPE is to simply add the HIPE to water—if it readily disperses in water, then it is a good water continuous HIPE. If the HIPE does not disperse readily, then the HIPE may be improperly formed. When making a HIPE with a thick oil external phase, for example a PDMS at 100K cSt (100K cSt means 100,000 cSt), then it may be possible to mix the oil phase, emulsifying agent, and external phase all together at the same time and mix slowly by modest agitation. A HIPE may be easily formed with this procedure. An advantage to a HIPE, compared to a conventional emulsion, is that a HIPE may allow for processing with a relatively low amount of water. Such a low amount of water may be useful for unit dose executions of the present invention, wherein, for example, fabric care compositions are contained in a water soluble sachet comprised of polyvinyl alcohol ("PVOH") film. Such PVOH films generally require a relatively low level of water. In one embodiment, the concentrated fabric care composition comprises from about 0% to about 20%, alternatively from about 5% to about 15%, alternatively from about 8% to about 13% of water by weight of the fabric care composition.

In one embodiment, the composition is a highly concentrated composition. A high internal phase emulsion of silicone that is water continuous is prepared before addition to the rest of the formulation.

In another embodiment, the composition is a non-concentrated composition. In this embodiment, the silicone is not, at least initially, emulsified, i.e., the silicone can be emulsified in the fabric care composition itself.

In yet another embodiment, the fabric care composition is free or essentially free of a silicone.

B. Other Water Insoluble Fabric Care Benefit Agents

In addition to or in lieu of silicone, other materials can be used as well as fabric care benefit agents. Non-limiting examples of these other agents include: fatty oils, fatty acids, soaps of fatty acids, fatty triglycerides, fatty alcohols, fatty esters, fatty amides, fatty amines; sucrose esters, dispersible polyethylenes, polymer latexes, and clays.

Nonionic fabric care benefit agents can comprise sucrose esters, and are typically derived from sucrose and fatty acids. Sucrose ester is composed of a sucrose moiety having one or more of its hydroxyl groups esterified.

Sucrose is a disaccharide having the following formula:

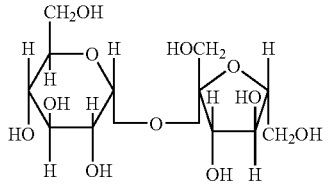

Alternatively, the sucrose molecule can be represented by the formula: $M(OH)_8$, wherein M is the disaccharide backbone and there are total of 8 hydroxyl groups in the molecule.

Thus, sucrose esters can be represented by the following formula:

$$M(OH)_{8-x}(OC(O)R^1)_x$$

wherein x is the number of hydroxyl groups that are esterified, whereas (8-x) is the hydroxyl groups that remain unchanged; x is an integer selected from 1 to 8, alternatively from 2 to 8, alternatively from 3 to 8, or from 4 to 8; and $R^1$ moieties are independently selected from $C_1$-$C_{22}$ alkyl or $C_1$-$C_{30}$ alkoxy, linear or branched, cyclic or acyclic, saturated or unsaturated, substituted or unsubstituted.

In one embodiment, the $R^1$ moieties comprise linear alkyl or alkoxy moieties having independently selected and varying chain length. For example, $R^1$ may comprise a mixture of linear alkyl or alkoxy moieties wherein greater than about 20% of the linear chains are $C_{18}$, alternatively greater than about 50% of the linear chains are $C_{18}$, alternatively greater than about 80% of the linear chains are $C_{18}$.

In another embodiment, the $R^1$ moieties comprise a mixture of saturate and unsaturated alkyl or alkoxy moieties; the degree of unsaturation can be measured by "Iodine Value" (hereinafter referred as "IV", as measured by the standard AOCS method). The IV of the sucrose esters suitable for use herein ranges from about 1 to about 150, or from about 2 to about 100, or from about 5 to about 85. The $R^1$ moieties may be hydrogenated to reduce the degree of unsaturation. In the case where a higher IV is preferred, preferably from about 40 to about 95, then oleic acid and fatty acids derived from soybean oil and canola oil are the preferred starting materials.

In a further embodiment, the unsaturated $R^1$ moieties may comprise a mixture of "cis" and "trans" forms about the unsaturated sites. The "cis"/"trans" ratios may range from about 1:1 to about 50:1, or from about 2:1 to about 40:1, or from about 3:1 to about 30:1, or from about 4:1 to about 20:1.

Non-limiting examples of water insoluble fabric care benefit agents include dispersible polyethylene and polymer latexes. These agents can be in the form of emulsions, latexes, dispersions, suspensions, and the like. Preferably they are in the form of an emulsion or a latex. Dispersible polyethylenes and polymer latexes can have a wide range of particle size diameters ($\chi_{50}$) including but not limited to from about 1 nm to about 100 um; alternatively from about 10 nm to about 10 um. As such, the preferred particle sizes of dispersible polyethylenes and polymer latexes are generally, but without limitation, smaller than silicones or other fatty oils.

Generally, any surfactant suitable for making polymer emulsions or emulsion polymerizations of polymer latexes can be used to make the water insoluble fabric care benefit agents of the present invention. Suitable surfactants consist of emulsifiers for polymer emulsions and latexes, dispersing agents for polymer dispersions and suspension agents for polymer suspensions. Suitable surfactants include anionic, cationic, and nonionic surfactants, or combinations thereof. Nonionic and anionic surfactants are preferred. In one embodiment, the ratio of surfactant to polymer in the water insoluble fabric care benefit agent is about 1:100 to about 1:2; alternatively from about 1:50 to about 1:5, respectively. Suitable water insoluble fabric care benefit agents include but are not limited to the examples described below.

Dispersible Polyolefins

Generally, all dispersible polyolefins that provide fabric care benefits can be used as water insoluble fabric care benefit agents in the present invention. The polyolefins can be in the format of waxes, emulsions, dispersions or suspensions. Non-limiting examples are discussed below.

In one embodiment, the polyolefin is chosen from a polyethylene, polypropylene, or a combination thereof. The polyolefin may be at least partially modified to contain various functional groups, such as carboxyl, alkylamide, sulfonic acid or amide groups. In another embodiment, the polyolefin is at least partially carboxyl modified or, in other words, oxidized.

For ease of formulation, the dispersible polyolefin may be introduced as a suspension or an emulsion of polyolefin dispersed by use of an emulsifying agent. The polyolefin suspension or emulsion preferably comprises from about 1% to about 60%, alternatively from about 10% to about 55%, alternatively from about 20% to about 50% by weight of polyolefin. The polyolefin preferably has a wax dropping point (see ASTM D3954-94, volume 15.04—"Standard Test Method for Dropping Point of Waxes") from about 20° to about 170° C., alternatively from about 50° to about 140° C. Suitable polyethylene waxes are available commercially from suppliers including but not limited to Honeywell (A-C polyethylene), Clariant (Velustrole® emulsion), and BASF (LUWAX®).

When an emulsion is employed with the dispersible polyolefin, the emulsifier may be any suitable emulsification agent. Non-limiting examples include an anionic, cationic, nonionic surfactant, or a combination thereof. However, almost any suitable surfactant or suspending agent may be employed as the emulsification agent. The dispersible polyolefin is dispersed by use of an emulsification agent in a ratio to polyolefin wax of about 1:100 to about 1:2, alternatively from about 1:50 to about 1:5, respectively.

Polymer Latexes

Polymer latex is made by an emulsion polymerization which includes one or more monomers, one or more emulsifiers, an initiator, and other components familiar to those of ordinary skill in the art. Generally, all polymer latexes that provide fabric care benefits can be used as water insoluble fabric care benefit agents of the present invention. Non-limiting examples of suitable polymer latexes include those disclosed in WO 02/18451; US 2004/0038851 A1; and US 2004/0065208 A1. Additional non-limiting examples include the monomers used in producing polymer latexes such as: (1) 100% or pure butylacrylate; (2) butylacrylate and butadiene mixtures with at least 20% (weight monomer ratio) of butylacrylate; (3) butylacrylate and less than 20% (weight monomer ratio) of other monomers excluding butadiene; (4) alkylacrylate with an alkyl carbon chain at or greater than $C_6$; (5) alkylacrylate with an alkyl carbon chain at or greater than $C_6$ and less than 50% (weight monomer ratio) of other monomers; (6) a third monomer (less than 20% weight monomer ratio) added into an aforementioned monomer systems; and (7) combinations thereof.

Polymer latexes that are suitable fabric care benefit agents in the present invention may include those having a glass transition temperature of from about −120° C. to about 120° C., alternatively from about −80° C. to about 60° C. Suitable emulsifiers include anionic, cationic, nonionic and amphoteric surfactants. Suitable initiators include initiators that are suitable for emulsion polymerization of polymer latexes. The particle size diameter ($\chi_{50}$) of the polymer latexes can be from about 1 nm to about 10 μm, alternatively from about 10 nm to about 1 μm, preferably from about 10 nm to about 20 nm.

In one embodiment, the fabric care composition of the present invention is free or essentially free of other water insoluble fabric care benefit agents.

C. Coacervate Phase

One aspect of this invention provides for a process of combining a coacervate phase and a water insoluble fabric care benefit agent. Another aspect of the invention provides for a process of combining a coacervate phase and a silicone. In one embodiment, the coacervate phase is comprised of a cationic polymer and an anionic surfactant.

The level of the coacervate in the compositions of the present invention are from about 0.01% to about 20%, alternatively from about 0.1% to about 10%, and alternatively from about 0.5% to about 2%, by weight of the fabric care composition. These percentages account only for the cationic polymer and anionic surfactant materials and not any water that may or may not be associated with the coacervate. It is surprising that such relatively small amounts of coacervate in the compositions of the present invention may provide such a relatively large increase in the effective deposition to fabric care active such as silicone.

The fabric care compositions of the present invention, in one embodiment, involve the formation of a coacervate phase. The phrase "coacervate phase" is used herein in the broadest sense to include all kinds of separated polymer phases known by the person skilled in the fabric care art such as disclosed in L. Piculell & B. Lindman, Adv. Colloid Interface Sci., 41 (1992) and in B. Jonsson, B. Lindman, K. Holmberg, & B. Kronberb, "Surfactants and Polymers In Aqueous Solution", John Wiley & Sons, 1998. The mechanism of coacervation and all its specific forms are described in "Interfacial Forces in Aqueous Media", C. J. van Oss, Marcel Dekker, 1994, pages 245 to 271. One skilled in the art will readily appreciate the phrase "coacervate phase," is also often referred to the literature as a "complex coacervate phase" or as "associated phase separation."

Generally, and for the purpose of one embodiment of the present invention, the coacervate is formed by a cationic polymer and an anionic surfactant. In another embodiment of the present invention, the coacervate may be formed by an anionic polymer and a cationic surfactant. More complex coacervates can also be formed with other charged materials in the fabric care composition, i.e., in conjunction with anionic, cationic, zwitterionic and/or amphoteric surfactants or polymers, or mixtures thereof.

One skilled in the art will readily be able to identify whether a coacervate is formed, and techniques for analysis of formation of coacervates are known in the art. For example, microscopic analyses of the compositions, at any chosen stage of dilution, can be utilized to identify whether a coacervate phase has formed. Such a coacervate phase will be identifiable as an additional dispersed phase in the composition. Texture enhancing microscopy can be used such as phase contrast and Nomarski optics to help identify a coacervate phase. The use of dyes can aid in distinguishing the coacervate phase from other insoluble phases dispersed in the composition. For example, an "Anionic Red Dye Test" may be used as described herein.

Anionic Red Dye Coacervate Identification Test

This procedure can be used to qualitatively identify the presence of a cationic polymer and anionic surfactant coacervate in an STW composition; for example, one containing a silicone. The anionic Direct Red No. 80 dye will prefer to be with the cationic polymer if it is present, and the coacervate has a distinct amorphous shape and texture from the rest of the matrix.

Procedure:

Combine 0.5 g of 25% active Direct Red No. 80 dye powder (from Sigma-Aldrich) and 19.5 g DI water for a 0.625% dye solution. Add 5 drops of dye solution to 25 g of test product and stir.

Evaluation:

Centrifugation: Place 10 mL of dyed product into a 15 mL centrifuge tube and centrifuge for 30 minutes at 10,000 rpm. (for example, use a Beckman Ultima L-70K ultracentrifuge with SW40Ti rotor). If there is no coacervate there will normally only be 2 layers. A top silicone layer and a bottom water/solvent layer that both contain dye. If there is a coacervate, there will be 3 distinct layers. A top whitish silicone layer, a middle layer containing the red dyed coacervate, and a water/solvent layer at the bottom.

Evaluation under microscope: Prepare a slide of dyed product and evaluate under microscope (for example, use an Olympus BH2 microscope, 20× objective, normal light source). If there is no coacervate, the appearance of spherical silicone droplets can be seen with an evenly distributed pink hue from the Direct Red No. 80 dye. The coacervate appears as amorphous or stringy globs that are an intense red color compared to the surrounding matrix.

Evaluation upon dilution: Place 0.5 g of dyed product into a container and dilute with 49.5 g DI water for a 1:100 dilution. If there is no coacervate, the solution appears homogeneous with a uniform red color throughout with few/no particles seen. A coacervate will appear as small particles with an intense red color floating in the clear water solution.

When the coacervate phase is formed by a cationic polymer being combined with anionic surfactant, it is preferred that the coacervate phase is formed first, already built in the finished fabric care composition. It is also preferred the coacervate phase is suspended in a structured matrix. Although less preferred but still within the scope of the invention, the coacervate phase may also be formed upon dilution of the composition with a diluent during the laundry treatment application, e.g. during the wash cycle and/or during the rinse cycle.

In another embodiment of the present invention, the STW composition may contain an insufficient amount of an anionic surfactant to form a complete coacervate with the cationic polymer, or a very low amount or even no anionic surfactant. In this case some or all of the coacervate is formed in the wash cycle by interaction of the cationic polymer contained in the STW composition with the anionic surfactant(s) delivered to wash cycle by the laundry detergent used. In this case, part or all of the coacervate is formed in-situ in the washing cycle of the laundry process. While generally less effective and reliable, this composition and method are within the scope of the present invention.

In another case of a fabric care article comprising a dual compartment package (for example, a dual compartment, dual pouring plastic bottle; a dual compartment tray with a peel-off lid; a dual compartment pouch made from a non-water soluble film; or a dual compartment unit dose made from water soluble film such as. polyvinyl alcohol film) wherein an STW composition of the present invention is placed in one compartment and a second fabric care composition is placed in the second compartment (for example, a liquid laundry detergent), it is possible to have the silicone in the STW composition and the cationic polymer in the other fabric care composition, for example, a liquid detergent. The detergent can contain anionic surfactant which forms a coacervate with the cationic polymer. The compositions are thus added to the wash together as instructed and indicated by the form of packaging. The coacervate in the second compartment improves the deposition of silicone delivered from the STW composition in the first compartment. While not as effective or reliable, these compositions, articles, and methods are within the scope of the present invention.

Alternatively, the cationic polymer and the anionic surfactant coacervate can be in the STW composition and be placed in the first compartment of a dual compartment package, and the silicone can be placed in the fabric care composition in the second compartment of the dual compartment package, for example a liquid detergent. The coacervate in the first compartment in the STW composition improves the deposition of silicone delivered from the fabric care composition (for example, a liquid detergent) in the second compartment While not as effective or reliable, these compositions, articles, and methods are within the scope of the present invention.

In yet another article, the cationic polymer can be in the STW composition and be placed in the first compartment of a dual compartment package, and the silicone and the anionic surfactant can be placed in the fabric care composition in the second compartment of the dual compartment package, for example a liquid detergent. In this case, all of the coacervate is formed in situ in the washing cycle of the laundry process. The cationic polymer in the first compartment in the STW composition improves the deposition of silicone delivered from the fabric care composition (for example, a liquid detergent) in the second compartment. While generally not as effective or reliable, these compositions, articles, and methods are within the scope of the present invention.

In yet another article, the cationic polymer anionic surfactant coacervate and liquid detergent (for example, a nonionic liquid detergent) and the silicone can be placed in the first compartment of a dual compartment package, and at least one other fabric care agent (for example, an SCA) can be placed in the second compartment of the dual compartment package (for example, a dual compartment PVOH unit dose pouch).

In yet another article, the cationic polymer and an anionic surfactant—containing detergent and the silicone can be placed in the first compartment of a dual compartment package, and at least one other fabric care agent (for example, an SCA) can be placed in the second compartment of the dual compartment package (for example, a dual compartment PVOH unit dose pouch).

1. Cationic Polymers

The term "cationic polymer" is used herein the broadest sense to include any polymer (including, in one embodiment, a cationic surfactant) which has a cationic charge and is suitable constituent in forming a coacervate, wherein the coacervate is suitable for aiding the deposition of a fabric conditioning active, preferably wherein the active is a silicone of the present invention.

While silicone polymers can provide fabric conditioning benefits, these benefits can be greatly increased with use of a deposition aid. In a preferred embodiment, the deposition aid is a cationic polymer, which is interacted with an anionic surfactant to form a coacervate. While not to be bound by theory, it is believed that the coacervate sweeps up small silicone droplets in the wash and helps drag them to the fabric surface. For example, the use of a cationic guar gum and anionic surfactant as a coacervate may effectively increase the deposition efficiency of silicone deposited on the fabrics from an STW composition of the present invention. The coacervate also may help prevent the silicone droplets from being rinsed off the fabrics in the rinse cycle.

The fabric care compositions herein can contain from about 0.001% to about 10%, alternatively from about 0.01% to about 5%, alternatively from about 0.1% to about 2%, of cationic polymer, typically having a molecular weight of from about 500 to about 5,000,000 (although some cationic starches can be as high as 10,000,000 in molecular weight), alternatively from about 1,000 to about 2,000,000, alternatively from about 1,000 to about 1,000,000, and alternatively from about 2,000 to about 500,000 and a charge density of at least about 0.01 meq/gm., and up to about 23 meq/gm., alternatively from about 0.05 to about 8 meq/gm., alternatively from about 0.08 to about 7 meq/gm., and even alternatively from about 0.1 to about 1 milliequivalents/gram (meq/gm). In the coacervate phase, the level of cationic polymer can range from about 20% to about 80%, alternatively from about 30% to about 80% by weight of the coacervate phase, which does not include any water that might be associated with the coacervate phase, with the balance being an anionic surfactant. The optimum ratio of anionic surfactant and cationic polymer is normally determined by the charge densities of the materials. The objective is to neutralize most or all the positive charge associated with the cationic polymer with the negative charge associated with the anionic surfactant. However, having an excess level of anionic surfactant in the composition is not objectionable, and may even assist with dispersing the STW composition in the wash cycle.

The cationic polymers of the present invention can be amine salts or quaternary ammonium salts. Preferred are quaternary ammonium salts. They include cationic derivatives of natural polymers such as some polysaccharide, gums, starch and certain cationic synthetic polymers such as polymers and copolymers of cationic vinyl pyridine or vinyl pyridinium halides. Preferably the polymers are water-soluble, for instance to the extent of at least 0.5% by weight are soluble in water at 20° C. Preferably the polymers have molecular weights (Daltons) of from about 500 to about 5,000,000, preferably from about 1,000 to about 2,000,000, more preferably from about 1,000 to about 1,000,000, and even more preferably from about 2,000 to about 500,000, and especially from about 2000 to about 100,000. As a general rule, the lower the molecular weight, the higher the degree of substitution (D.S.) by cationic, usually quaternary groups, which is desirable, or, correspondingly, the lower the degree of substitution, the higher the molecular weight which is desirable, but no precise relationship appears to exist. In general, the cationic polymers may have a charge density of at least about 0.01 meq/gm., preferably from about 0.05 to about 8 meq/gm., more preferably from about 0.08 to about 7 meq/gm., and even more preferably from about 0.1 to about 1 meq/gm. Cationic polymers are disclosed in U.S. Pat. No. 6,492,322 at column 6, line 65 to column 24, line 24. Other cationic polymers are disclosed in the CTFA "International Cosmetic Ingredient Dictionary and Handbook," Tenth Edition, Tara E. Gottschalck and Gerald N. McEwen, Jr., editors, published by The Cosmetic, Toiletry, and Fragrance Association, 2004. Still other cationic polymers are described at U.S. Patent Publication 2003-0139312 A1, published Jul. 24, 2003, from paragraph 317 to paragraph 347. The list of the cationic polymers includes the following.

In one embodiment, the cationic polymer comprises a polysaccharide gum. Of the polysaccharide gums, guar and locust bean gums, which are galactomannam gums are available commercially, and are preferred. In another embodiment, the cationic polymer comprises cationic guar gum. Guar gums are marketed under Trade Names CSAA M/200, CSA 200/50 by Meyhall and Stein-Hall, and hydroxyalkylated guar gums are available from the same suppliers. Other polysaccharide gums commercially available include: Xanthan Gum; Ghatti Gum; Tamarind Gum; Gum Arabic; and Agar. Cationic guar gums under the Trade Name N-Hance are available from Aqualon.

Suitable cationic starches and derivatives are the natural starches such as those obtained from maize, wheat, barley etc., and from roots such as potato, tapioca etc., and dextrins, particularly the pyrodextrins such as British gum and white dextrin.

Some preferred individual cationic polymers are the following: Polyvinyl pyridine, molecular weight about 40,000, with about 60% of the available pyridine nitrogens quaternized; copolymer of 70/30 molar proportions of vinyl pyridine/styrene, molecular weight about 43,000, with about 45% of the available pyridine nitrogens quaternized as above; copolymers of 60/40 molar proportions of vinyl pyridine/acrylamide, with about 35% of the available pyridine nitrogens quaternized as above; copolymers of 77/23 and 57/43 molar proportions of vinyl pyridine/methyl methacrylate, molecular weight about 43,000, with about 97% of the available pyridine nitrogens quaternized as above. These cationic polymers are effective in the compositions at very low concentrations for instance from 0.001% by weight to 0.2% especially from about 0.02% to 0.1% by weight of the fabric care composition.

Some other cationic polymers include: copolymer of vinyl pyridine and N-vinyl pyrrolidone (63/37) with about 40% of the available pyridine nitrogens quaternized; copolymer of vinyl pyridine and acrylonitrile (60/40), quaternized as above; copolymer of N,N-dimethyl amino ethyl methacrylate and styrene (55/45) quaternized as above at about 75% of the available amino nitrogen atoms; and Eudragit E™ (Rohm GmbH) quaternized as above at about 75% of the available amino nitrogens. Eudragit E™ is believed to be copolymer of N,N-dialkyl amino alkyl methacrylate and a neutral acrylic acid ester, and to have molecular weight about 100,000 to 1,000,000. Another example of a cationic polymer includes a copolymer of N-vinyl pyrrolidone and N,N-diethyl amino methyl methacrylate (40/50), quaternized at about 50% of the available amino nitrogens. These cationic polymers can be prepared in a known manner by quaternizing the basic polymers.

Other useful cationic polymer examples include Magnafloc 370 (from Ciba Specialty Chemicals) also know by the CTFA name as Polyquaternium-6, as well as Polyquaternium-10 and Polyquaternium-24 (from Amerchol Corporation), and polyvinylamine also known as Lupamin (e.g., Lupamin 1595 and Lupamin 5095 from BASF). Magnafloc 370 has a relatively high charge density of about 6 meq/g. Lupamins can have molecular weights from about 10,000 to about 20,000 and a very high charge density of about 23 meq/g. Other examples of cationic polymers are chitosan, oligochitosan (preferred are materials with a molecular weight from about 500 to about 2,000,000, more preferably from about 500 to about 50,000; a degree of acetylation of from about 70% and lower; and a polydispersity of from about 0 to about 10, preferably from about 1 to about 3), chitosan derivatives, quaternized chitosan, and Syntahlen CR (Polyquaternium-37) available from 3V.

Further examples of cationic polymers include cationic polymeric salts such as quaternized polyethyleneimines. These have at least 10 repeating units, some or all being quaternized. Commercial examples of polymers of this class are also sold under the generic Trade Name Alcostat™ by Allied Colloids. Typical examples of cationic polymers are disclosed in U.S. Pat. No. 4,179,382 to Rudkin, et. al., column 5, line 23 through column 11, line 10. Each polyamine nitrogen whether primary, secondary or tertiary, is further defined as being a member of one of three general classes; simple substituted, quaternized or oxidized. The polymers are made neutral by water-soluble anions such as chlorine ($Cl^-$), bromine ($Br^-$), iodine ($I^-$) or any other negatively charged radical such as sulfate ($SO_4^{2-}$) and methosulfate ($CH_3SO_3^-$). Specific polyamine backbones are disclosed in U.S. Pat. Nos. 2,182,306; 3,033,746; 2,208,095; 2,806,839; 2,553,696. An example of modified polyamine cationic polymers of the present invention comprising PEI's comprising a PEI backbone wherein all substitutable nitrogens are modified by replacement of hydrogen with a polyoxyalkyleneoxy unit, —$(CH_2CH_2O)_7H$. Other suitable polyamine cationic polymers comprise this molecule which is then modified by subsequent oxidation of all oxidizable primary and secondary nitrogens to N-oxides and/or some backbone amine units are quaternized, e.g. with methyl groups.

Preferred cationic polymers include cationic guar gums and cationic cellulose polymers. The preferred cationic guar gums include the N-Hance® 3000 series from Aqualon (N-Hance® 3000, 3196, 3198, 3205, and 3215). These have a range of charge densities from about 0.07 to about 0.95 meq/gm. Another effective cationic guar gum is Jaguar C-13S. Cationic guar gums are a highly preferred group of cationic polymers in compositions according to the present invention and act both as scavengers for residual anionic surfactant (if used in the rinse cycle) and also add to the softening effect of cationic textile softeners even when used in baths containing little or no residual anionic surfactant. The other polysaccharide-based gums can be quaternized similarly and act substantially in the same way with varying degrees of effectiveness. Cationic guar gums and methods for making them are disclosed in British Pat. No. 1,136,842 and U.S. Pat. No. 4,031,307. Preferably cationic guar gums have a D.S. of from about 0.1 to about 0.5.

Some highly preferred cationic guar gums and their physical properties are shown below:

| Cationic Polymer | Supplier | MW | Viscosity | Degree of Substitution |
|---|---|---|---|---|
| Meypro-Coat 21 | Rhodia | 50K | 100 (3%) | 0.1 |
| N-Hance 3269 | Aqualon | 500K | 25-65 (1%) | 0.13 |
| Jaguar Exel | Rhodia | na | 500 (1%) | 0.1 |
| N-Hance 3000 | Aqualon | 1200K | 1000-2000 (1%) | 0.07 |
| N-Hance 3196 | Aqualon | 1600K | 4000-5000 (1%) | 0.13 |
| Jaguar C-13S | Rhodia | 2000K | 3000 (1%) | 0.13 |
| Jaguar C-17 | Rhodia | 2000K | 3000 (1%) | 0.17 |
| N-Hance 3215 | Aqualon | 1500K | 3200-4200 (1%) | 0.20 |

Cationic hydroxypropyl guars can also be use as cationic deposition aids, but may give somewhat lower performance. Useful examples include Jaguar C-162 and Jaguar C-2000 (ex. Rhodia).

Cationic cellulose polymers can also be used and another preferred class of materials. Included are "amphoteric" polymers of the present invention since they will also have a net cationic charge, i.e.; the total cationic charges on these polymers will exceed the total anionic charge. The degree of substitution of the cationic charge can be in the range of from about 0.01 (one cationic charge per 100 polymer repeating units) to about 1.00 (one cationic charge on every polymer repeating unit) and preferably from about 0.01 to about 0.20. The positive charges could be on the backbone of the polymers or the side chains of polymers.

While there are many ways to calculate the charge density of cationic celluloses, the degree of substitution of the cationic charge can be simply calculated by the cationic charges per 100 glucose repeating units. One cationic charge per 100 glucose repeating units equals to 1% charge density of the cationic celluloses.

Preferred cationic celluloses for use herein include those which may or may not be hydrophobically-modified, having a molecular weight (Dalton) of from about 50,000 to about 2,000,000, more preferably from about 100,000 to about 1,000,000, and most preferably from about 200,000 to about 800,000. These cationic materials have repeating substituted anhydroglucose units that correspond to the general Structural Formula I as follows:

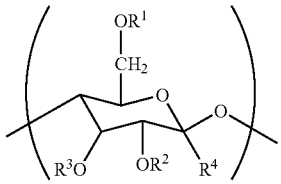

wherein $R^1$, $R^2$, $R^3$ are each independently H, $CH_3$, $C_{8-24}$ alkyl (linear or branched),

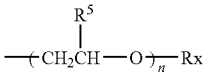

or mixtures thereof; wherein n is from about 1 to about 10; Rx is H, $CH_3$, $C_{8-24}$ alkyl (linear or branched),

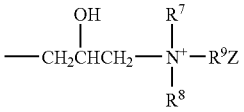

or mixtures thereof, wherein Z is a water soluble anion, preferably a chlorine ion and/or a bromine ion; $R^5$ is H, $CH_3$, $CH_2CH_3$, or mixtures thereof; $R^7$ is $CH_3$, $CH_2CH_3$, a phenyl group, a $C_{8-24}$ alkyl group (linear or branched), or mixture thereof; and $R^8$ and $R^9$ are each independently $CH_3$, $CH_2CH_3$, phenyl, or mixtures thereof: $R^4$ is H,

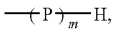

or mixtures thereof wherein P is a repeat unit of an addition polymer formed by radical polymerization of a cationic monomer such as

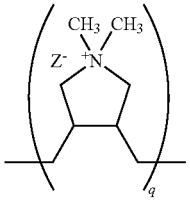

wherein Z' is a water-soluble anion, preferably chlorine ion, bromine ion or mixtures thereof and q is from about 1 to about 10.

The charge density of the cationic celluloses herein (as defined by the number of cationic charges per 100 glucose units) is preferably from about 0.5% to about 60%, more preferably from about 1% to about 20%, and most preferably from about 2% to about 10%.

Alkyl substitution on the anhydroglucose rings of the polymer ranges from about 0.01% to about 5% per glucose unit, more preferably from about 0.05% to about 2% per glucose unit, of the polymeric material.

The cationic cellulose ethers of Structural Formula I likewise include those which are commercially available and further include materials which can be prepared by conventional chemical modification of commercially available materials. Commercially available cellulose ethers of the Structural Formula I type include the JR 30M, JR 400, JR 125, LR 400 and LK 400 polymers, all of which are marketed by Dow Chemical.

Another example of a cationic polymer is a cationic polysaccharide, preferably starch, compound. The terms "polysaccharide" and "cationic starch" are used herein in the broadest sense. A cationic starch can also be used as a fabric care active, e.g., for softness and conditioning. Cationic starches are described in U.S. Pat. Pub. 2004/0204337 A1.

In one embodiment, the fabric care composition is free or essentially free of a cationic polymer.

2. Anionic Surfactant (for Forming a Coacervate)

The term "anionic surfactant" is used herein the broadest sense to include any surfactant (including, in one embodiment, an anionic polymer) which has an anionic charge and is a suitable constituent in forming a coacervate, wherein the coacervate is suitable for aiding the deposition of a fabric conditioning active, preferably wherein the active is a silicone of the present invention. Suitable anionic surfactants useful herein can comprise any of the conventional anionic surfactant types typically used in liquid and/or solid detergent products. These include the alkyl benzene sulfonic acids and their salts as well as alkoxylated or non-alkoxylated alkyl sulfate materials. The level of anionic surfactant needed to form the coacervate will of course vary depending of the particular cationic polymer and anionic surfactant selected. The optimum ratio of anionic surfactant and cationic polymer is normally determined by the charge densities of the materials. Typically the anionic surfactant level in the STW compositions of the present invention that are needed to form the coacervate are from about 0.001% to about 15%, preferably from about 0.01% to about 10%, more preferably from about 0.1% to about 6% and even more preferably from about 1% to about 5%, by weight of the STW composition.

Exemplary anionic surfactants are the alkali metal salts of $C_{10-16}$ alkyl benzene sulfonic acids, preferably $C_{11-14}$ alkyl benzene sulfonic acids. Preferably the alkyl group is linear and such linear alkyl benzene sulfonates are known as "LAS". Alkyl benzene sulfonates, and particularly LAS, are well known in the art. Such surfactants and their preparation are described for example in U.S. Pat. Nos.: 2,220,099 and 2,477,383. Especially preferred are the sodium and potassium linear straight chain alkylbenzene sulfonates in which the average number of carbon atoms in the alkyl group is from about 11 to 14. Sodium $C_{11}$-$C_{14}$, e.g., $C_{12}$, LAS is a specific example of such surfactants.

Another exemplary type of anionic surfactant comprises ethoxylated alkyl sulfate surfactants. Such materials, also known as alkyl ether sulfates or alkyl polyethoxylate sulfates, are those which correspond to the formula: R'—O—$(C_2H_4O)_n$—$SO_3M$ wherein R' is a $C_8$-$C_{20}$ alkyl group, n is from about 1 to 20, and M is a salt-forming cation. In a specific embodiment, R' is $C_{10}$-$C_{18}$ alkyl, n is from about 1 to 15, and M is sodium, potassium, ammonium, alkylammonium, or alkanolammonium. In more specific embodiments, R' is a $C_{12}$-$C_{16}$, n is from about 1 to 6 and M is sodium.

The alkyl ether sulfates will generally be used in the form of mixtures comprising varying R' chain lengths and varying degrees of ethoxylation. Frequently such mixtures will inevitably also contain some non-ethoxylated alkyl sulfate materials, i.e., surfactants of the above ethoxylated alkyl sulfate formula wherein n=0. Non-ethoxylated alkyl sulfates may also be added separately to the compositions of this invention and used as or in any anionic surfactant component which may be present. Specific examples of non-alkoyxylated, e.g., non-ethoxylated, alkyl ether sulfate surfactants are those produced by the sulfation of higher $C_8$-$C_{20}$ fatty alcohols. Conventional primary alkyl sulfate surfactants have the general formula: $ROSO_3^{31}$ $M^+$ wherein R is typically a linear $C_8$-$C_{20}$ hydrocarbyl group, which may be straight chain or branched chain, and M is a water-solubilizing cation. In specific embodiments, R is a $C_{10}$-$C_{15}$ alkyl, and M is alkali metal, more specifically R is $C_{12}$-$C_{14}$ and M is sodium.

Specific, nonlimiting examples of anionic surfactants useful herein include: a) $C_{11}$-$C_{18}$ alkyl benzene sulfonates (LAS); b) $C_{10}$-$C_{20}$ primary, branched-chain and random alkyl sulfates (AS); c) $C_{10}$-$C_{18}$ secondary (2,3) alkyl sulfates having formulae (I) and (II):

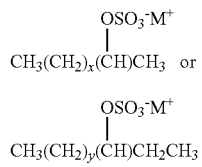

(I)

(II)

wherein M in formulae (I) and (II) is hydrogen or a cation which provides charge neutrality, and all M units, whether associated with a surfactant or adjunct ingredient, can either be a hydrogen atom or a cation depending upon the form isolated by the artisan or the relative pH of the system wherein the compound is used, with non-limiting examples of preferred cations including sodium, potassium, ammonium, and mixtures thereof, and x is an integer of at least about 7, preferably at least about 9, and y is an integer of at least 8, preferably at least about 9; d) $C_{10}$-$C_{18}$ alkyl alkoxy sulfates ($AE_xS$) wherein preferably x is from 1-30; e) $C_{10}$-$C_{18}$ alkyl alkoxy carboxylates preferably comprising 1-5 ethoxy units; f) mid-chain branched alkyl sulfates as discussed in U.S. Pat. No. 6,020,303 and U.S. Pat. No. 6,060,443; g) mid-chain branched alkyl alkoxy sulfates as discussed in U.S. Pat. No. 6,008,181 and U.S. Pat. No. 6,020,303; h) modified alkylbenzene sulfonate (MLAS) as discussed in WO 99/05243, WO 99/05242, WO 99/05244, WO 99/05082, WO 99/05084, WO 99/05241, WO 99/07656, WO 00/23549, and WO 00/23548.; i) methyl ester sulfonate (MES); and j) alpha-olefin sulfonate (AOS).

C. Emulsifying and Dispersing Agents

The compositions of the present invention may contain a dispersing agent or an emulsifying agent to (1) form a conventional silicone emulsion or a high internal phase emulsion ("HIPE") silicone emulsion and/or (2) help disperse the composition (for example, in the wash cycle).

1. Anionic Surfactant

In one embodiment of the invention, the anionic surfactants previously described may be used to help disperse the compositions of the present invention in the wash cycle. In such an embodiment, the anionic surfactants are used non-detersive levels, such as between about 12% to about 0.01%, preferably from about 10% to about 0.1% by weight of the composition. Other suitable levels of the anionic surfactant may include from about 8% to about 1%, from about 2% to about 9%, from about 6% to about 3%, and from about 4% to about 5% by weight of the composition.

In another embodiment of the invention, anionic surfactants may be used to form the silicone emulsion, either conventional or HIPE. Preferred anionic surfactants include sodium lauryl sulfate, HLAS (C11-12 linear alkyl benzene sulfonic acid), sodium alkyl (C12-15) ethersulfates (C12-15AE1.1S, C12-15AE1.8S), and mixtures thereof. In preparing a conventional silicone emulsion, the surfactant level can vary in the range of from about 0.1% to about 20% by weight of the silicone emulsion and silicone can range from about 1% to about 60% by weight of the silicone emulsion with the balance being water. In a silicone HIPE, the surfactant level can vary from about 0.1% to about 25%, preferably from about 1% to about 10%) by weight of the HIPE and the silicone can range from about 74% to about 95% by weight of the HIPE with the balance being water. Alternatively, a HIPE can be prepared with solvent and little or no water, for example propylene glycol.

Methods to determining an anionic surfactant and level thereof include any method known in the art.

Other useful surfactants may include nonionics, cationics, zwitterionics, ampholytic surfactants, and mixtures thereof. These surfactants are emulsifers for the silicone and may also help disperse the composition in the wash cycle. In an alternative embodiment, the HIPE or silicone emulsion is free or substantially free of any one or more of these surfactants.

Nonionic Surfactants

Suitable nonionic surfactants useful herein for either emulsification of the silicone polymer or dispersing the composition in the wash (or both) can comprise any of the conventional nonionic surfactant types typically used in liquid and/or solid detergent products. These include alkoxylated fatty alcohols and amine oxide surfactants.

Suitable nonionic surfactants for use herein include the alcohol alkoxylate nonionic surfactants. Alcohol alkoxylates are materials which correspond to the general formula: $R^1(C_mH_{2m}O)_nOH$ wherein $R^1$ is a $C_8$-$C_{16}$ alkyl group, m is from 2 to 4, and n ranges from about 2 to 12. Preferably $R^1$ is an alkyl group, which may be primary or secondary, that contains from about 9 to 15 carbon atoms, more preferably from about 10 to 14 carbon atoms. In one embodiment, the alkoxylated fatty alcohols will also be ethoxylated materials that contain from about 2 to 12 ethylene oxide moieties per molecule, more preferably from about 3 to 10 ethylene oxide moieties per molecule.

The alkoxylated fatty alcohol materials useful in the detergent compositions herein will frequently have a hydrophilic-lipophilic balance (HLB) which ranges from about 3 to 17. More preferably, the HLB of this material will range from about 6 to 15, most preferably from about 8 to 15. Alkoxylated fatty alcohol nonionic surfactants have been marketed under the tradenames Neodol and Dobanol by the Shell Chemical Company.

Another suitable type of nonionic surfactant useful herein comprises the amine oxide surfactants. Amine oxides are materials which are often referred to in the art as "semi-polar" nonionics. Amine oxides have the formula:

$$R(EO)_x(PO)_y(BO)_zN(O)(CH_2R')_2.qH_2O.$$

In this formula, R is a relatively long-chain hydrocarbyl moiety which can be saturated or unsaturated, linear or branched, and can contain from 8 to 20, preferably from 10 to 16 carbon atoms, and is more preferably $C_{12}$-$C_{16}$ primary alkyl. R' is a short-chain moiety, preferably selected from hydrogen, methyl and —$CH_2OH$. When x+y+z is different from 0, EO is ethyleneoxy, PO is propyleneneoxy and BO is butyleneoxy. Amine oxide surfactants are illustrated by $C_{12-14}$ alkyldimethyl amine oxide.

Non-limiting examples of nonionic surfactants include: a) $C_{12}$-$C_{18}$ alkyl ethoxylates, such as, NEODOL® nonionic surfactants from Shell; b) $C_6$-$C_{12}$ alkyl phenol alkoxylates wherein the alkoxylate units are a mixture of ethyleneoxy and propyleneoxy units; c) $C_{12}$-$C_{18}$ alcohol and $C_6$-$C_{12}$ alkyl phenol condensates with ethylene oxide/propylene oxide block polymers such as Pluronic® from BASF; d) $C_{14}$-$C_{22}$ mid-chain branched alcohols, BA, as discussed in U.S. Pat. No. 6,150,322; e) $C_{14}$-$C_{22}$ mid-chain branched alkyl alkoxylates, $BAE_x$, wherein x 1-30, as discussed in U.S. Pat. No. 6,153,577, U.S. Pat. No. 6,020,303 and U.S. Pat. No. 6,093,856; f) Alkylpolysaccharides as discussed in U.S. Pat. No. 4,565,647

Llenado, issued Jan. 26, 1986; specifically alkylpolyglycosides as discussed in U.S. Pat. No. 4,483,780 and U.S. Pat. No. 4,483,779; g) Polyhydroxy fatty acid amides as discussed in U.S. Pat. No. 5,332,528, WO 92/06162, WO 93/19146, WO 93/19038, and WO 94/09099; and h) ether capped poly (oxyalkylated) alcohol surfactants as discussed in U.S. Pat. No. 6,482,994 and WO 01/42408.

Other preferred nonionic surfactants include Planteran 2000, Laureth-7 and Lonza PGE-10-1-L, Neodol 23-9, and Neodol 25-3, or mixtures thereof.

Anionic/Nonionic Combinations

In some cases, it is preferred to use a combination of anionic and nonionic surfactant materials. When this is the case, the weight ratio of anionic to nonionic will typically range from 10:90 to 95:5, more typically from 30:70 to 70:30, respectively.

Cationic Surfactants

Cationic surfactants are well known in the art and non-limiting examples of these include quaternary ammonium surfactants, which can have up to 26 carbon atoms. Additional examples include a) alkoxylate quaternary ammonium (AQA) surfactants as discussed in U.S. Pat. No. 6,136,769; b) dimethyl hydroxyethyl quaternary ammonium as discussed in U.S. Pat. No. 6,004,922; c) polyamine cationic surfactants as discussed in WO 98/35002, WO 98/35003, WO 98/35004, WO 98/35005, and WO 98/35006; d) cationic ester surfactants as discussed in U.S. Pat. Nos. 4,228,042, 4,239,660 4,260,529 and 6,022,844; and e) amino surfactants as discussed in U.S. Pat. No. 6,221,825 and WO 00/47708, specifically amido propyldimethyl amine (APA); f) combinations thereof.

Zwitterionic Surfactants

Non-limiting examples of zwitterionic surfactants include: derivatives of secondary and tertiary amines, derivatives of heterocyclic secondary and tertiary amines, or derivatives of quaternary ammonium, quaternary phosphonium or tertiary sulfonium compounds. See U.S. Pat. No. 3,929,678 to Laughlin et al., issued Dec. 30, 1975 at column 19, line 38 through column 22, line 48, for examples of zwitterionic surfactants; betaine, specific examples include alkyl dimethyl betaine and cocodimethyl amidopropyl betaine, $C_8$ to $C_{18}$ (preferably $C_{12}$ to $C_{18}$) amine oxides and sulfo and hydroxy betaines, such as N-alkyl-N,N-dimethylammino-1-propane sulfonate where the alkyl group can be $C_8$ to $C_{18}$, preferably $C_{10}$ to $C_{14}$.

Ampholytic Surfactants

Non-limiting examples of ampholytic surfactants include: aliphatic derivatives of secondary or tertiary amines, or aliphatic derivatives of heterocyclic secondary and tertiary amines in which the aliphatic radical can be straight- or branched-chain. One of the aliphatic substituents contains at least about 8 carbon atoms, typically from about 8 to about 18 carbon atoms, and at least one contains an anionic water-solubilizing group, e.g. carboxy, sulfonate, sulfate. See U.S. Pat. No. 3,929,678 at col. 19, lines 18-35, for examples of ampholytic surfactants.

D. Static Control Agents

One aspect of the invention provides for a composition of present invention comprising a static control agent. In one embodiment, the static control agent comprises ion-pair conditioning particles. In turn, these particles may comprise water-insoluble particles comprised of certain amine-organic anion ion-pair complexes and, optionally, certain amine-inorganic anion ion-pair complexes. The primary benefit of these conditioning particles in the present invention is to provide antistatic benefits to fabrics, especially those fabrics dried in a machine dryer. These complexes and other non-complexed materials that provide static control are hereafter called Static Control Agents (SCAs).

Although these complexes provide antistatic benefits to laundry, a problem posed by the use of these ingredients includes incompatibility with use of a perfume. Thus one aspect of the invention is based upon the surprising discovery of separating perfume and these ion-pair complexes before these compositions are administered during the laundry process.

The amine-organic anion ion-pair complexes can be represented by the following formula:

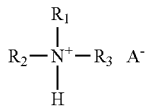

wherein each $R_1$ and $R_2$ can independently be $C_{12}$ to $C_{20}$ alkyl or alkenyl, and each $R_3$ is H or $CH_3$. A represents an organic anion and includes a variety of anions derived from anionic surfactants, as well as related shorter alkyl or alkenyl chain compounds which need not exhibit surface activity. A is selected from the group consisting of alkyl sulfonates, aryl sulfonates, alkylaryl sulfonates, alkyl sulfates, dialkyl sulfosuccinates, alkyl oxybenzene sulfonates, acyl isethionates, acylalkyl taurates, alkyl ethoxylated sulfates, and olefin sulfonates, and mixtures of such anions. A preferred starting material for "A" is cumene sulfonic acid.

As used herein the term alkyl sulfonate shall include those alkyl compounds having a sulfonate moiety at a fixed or predetermined location along the carbon chain, as well as compounds having a sulfonate moiety at a random position along the carbon chain.

The optionally incorporated amine-inorganic anion ion-pair complexes can be represented by the following formula:

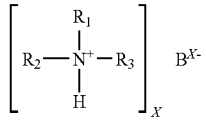

wherein each $R_1$ and $R_2$ can independently be $C_{12}$ to $C_{20}$ alkyl or alkenyl, each $R_3$ is H or $CH_3$, and x corresponds to the molar ratio of the amine to the inorganic anion and the valence of the inorganic anion, x being an integer between 1 and 3, inclusive. B is an inorganic anion such as, but not limited to, sulfate ($SO_4^{-2}$), hydrogen sulfate ($HSO_4^{-1}$), nitrate ($NO_3^-$), phosphate ($PO_4^{-3}$), hydrogen phosphate ($HPO_4^{-2}$), and dihydrogen phosphate ($H_2PO_4^{-1}$), and mixtures thereof, preferably sulfate or hydrogen sulfate.

In one embodiment, the SCA is a particle with an average particle diameter of from about 10 to about 500 microns. The term "average particle diameter" represents the mean particle size diameter of the actual particles of a given material. The mean is calculated on a weight percent basis. The mean is determined by conventional analytical techniques such as, for example, laser light diffraction or microscopic determination utilizing a light or scanning electron microscope. For typical manufacturing quality control, the Rotap screening method may be used.

These and other conditioning agent containing amine ion-pair complexes are described in U.S. Pat. Nos 4,861,502, 5,073,274, 5,019,280, 4,857,213, and 4,913,828 to Debra S. Caswell, et. al., and U.S. Pat. No. 4,915,854, Mao, et. al.

In one embodiment, the ion-pair conditioning particles conditioning agent is chosen from preferred materials listed in U.S. Pat. No. 5,019,280, at columns 4 and 5.

A suitable source for ion-pair SCAs include prills of nominally 70% distearyl amine+cumene sulfonic acid ion pair and 30% bis(distearyl)ammonium sulfate from Degussa. A preferred composition for the SCA is shown below. The particle size by the Rotap method is a median size of about 95 microns, with less than from about 10% to about 25% less than about 53 microns, and less than from about 4% to about 6% greater than about 177 microns. The level of SCA in the compositions of the present invention is from about 1to about 30%, preferably from about 2% to about 15%.

Structure of Distearyl Amine+Cumene Sulfonic Acid Ion Pair and Bis (Distearyl) Ammonium Sulfate

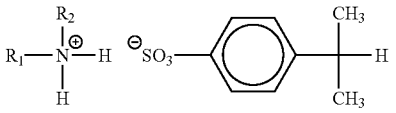

R1 and R2 = Stearyl

70%: Distearyl Amine—Cumene Sulfonic Acid Ion—Pair

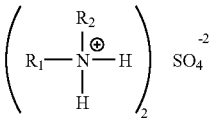

R1 and R2 = Stearyl

30%: Bis(distearyl)Ammonium Sulfate (sulfate salt of above distearyl protonated amine)

Other useful SCAs include alkyl and dialkyl imidazolines (both protonated and unprotonated) such as, for example, Varisoft 445 Imidazoline (ex. Degussa), polyethylenimines and ethoxylated polyethylenimines (preferred MW from about 2000 to about 25,000). Other cationic polymers may function as antistatic agents, for example Polyquatemium-6. While not wishing to be bound by theory, cationic polymers can function as antistatic agents added through the wash if they are able to maintain at least some cationic charge in or through the rinse cycle.

Still other antistatic agents include dialkyl and monoalkyl cationic surfactants, and combinations of monoalkyl cationic surfactant and fatty acids. Especially preferred are tallow trimethylammonium chloride, cocotrimethylammounium chloride, oleyltrimethylammounium chloride, and lauryltrimethylammonium chloride. Other examples are N,N-di(tallowoyloxyethyl)-N,N-dimethylammonium chloride (available from Akzo under the trade name Armosoft® DEQ), N,N-di(canola-oyloxyethyl)-N,N-dimethylammonium chloride (available from Degussa under the trade name Adogen® CDMC), and di-(oleoyloxyethyl)-N,N-methylhydroxyethylammonium methyl sulfate sold under the trade names Rewoquat® WE 15 and Varisoft® WE 16, both available from Degussa. Other antistatic agents include glycerol monostearate (Atmer® 129 from Uniqema), Ethofat® 245/25 (ethoxylated tall oil from Akzo Nobel), DC-5200® (lauryl PEG/PPG 18/18 methicone from Dow Coning), Ethomeen® 18/12 (bis [2-hydroxyethyl]octadecylamine from Akzo Nobel), Ethomeen® HT/12 (hydrogenated tallow amine 2 EO from Akzo Nobel), and Wacker L656 aminofunctional silicone (from Wacker Chemical Corporation). These are generally less effective SCAs when added to the wash cycle that contains an anionic detergent compared to the distearyl amine+cumene sulfonic acid ion pair and bis(distearyl)ammonium sulfate prills. However, if the STW composition is being formulated for a powder/liquid dual compartment unit dose pouch using PVOH film, then these and other effective SCAs can be used in powder or granular form in the powder side of the unit dose pouch. Effective SCAs are given in U.S. Patent Application Publication No. 2005/0020476 A1, ¶¶15-74.

It has been discovered that for the best longer term stability of the ion pair antistatic agents, especially the distearyl amine/cumene sulfonic acid and distearyl amine/sulfuric acid prills, the level of anionic surfactant in an aqueous based composition (water level at least about 50%) should be at least about 4%, preferably at least about 5%. While not wishing to be bound by theory, it appears that the higher levels of anionic surfactant can form a coating around the SCA particles and provide protection against an unfavorable interaction with water such as hydrolysis. This interaction with water can decrease the static control performance when the STW compositions are stored at elevated temperatures for longer periods of time, for example, at 38° C.

It has also been discovered that for best stability at higher storage temperatures (e.g., at 38° C.) of distearyl amine/cumene sulfonic acid and distearyl amine/sulfuric acid prills, the pH of the STW composition should be less than about 7, preferably from about 3 to about 7, more preferably from about 4 to about 6.

It has also been surprisingly found that perfumes may negatively interact with the distearyl amine/cumene sulfonic acid and distearyl amine/sulfuric acid prill, with longer storage times and higher temperatures in STW compositions. While not wishing to be bound by theory, it is believed that perfume components (perfume raw materials) that are hydrophobic solublize and/or destroy the ion pair prill leading to eventual breakup of the prill into smaller pieces and eventually chemical reversion of the acid/base reaction that formed the ion pair. This perfume interaction with the ion pair can be solved in several ways. If the STW composition is to be used in combination with a detergent product, for example, in a dual pour, dual compartment plastic bottle (an article where the STW composition and the detergent composition are dispensed at the same time but are physically separated in one container), then the perfume is added to the liquid detergent; and the SCA, especially the distearyl amine/cumene sulfonic acid and distearyl amine/sulfuric acid prills, is added to the STW composition. Another solution is to formulate the SCA into the detergent and the perfume into the STW composition. Thus, the perfume and SCA are physically separated in storage in the container and no interactions can occur. This same method can be used for unit dose packaging for the STW composition with either water-soluble or non-water soluble film or even dual compartment plastic containers or trays. For the water soluble unit dose case with polyvinyl alcohol film (PVOH), a dual compartment pouch is created by vacuum forming and sealing the films. The SCA and the perfume are physically separated since the SCA is in the powder side of the pouch and the perfume is in the STW composition in the liquid side of the pouch.

Another way to solve the stability issue is to form an article with two compartments such as a unit dose PVOH pouch. In this case, two liquid fills are used. On one side, the liquid or gel STW composition containing the SCA, esp. the distearyl amine/cumene sulfonic acid and distearyl amine/sulfuric acid prills is added, but does not contain the perfume in this case. The perfume is added to the other compartment of the dual compartment pouch either by itself or as a mixture in a dispersing solvent. An example of a dispersing solvent is dipropylene glycol or other glycols or solvatropes or fatty alcohol ethoxylates or mixtures thereof. The concentration of perfume with dispersing solvent can be from about 5% to about 95% by weight of perfume, preferably from about 15% to about 75% perfume, and more preferably from about 20% to about 50% perfume.

Even another way to solve the stability issue of perfume and SCA, especially with the distearyl amine/cumene sulfonic acid and distearyl amine/sulfuric acid prills, is to use perfume microcapsules instead of perfume oil. Perfume microcapsules are available from several suppliers such as Aveka (for example, a urea formaldehyde shell with a perfume core). An advantage for this approach is that perfume can effective be added to the STW compositions containing the distearyl amine/cumene sulfonic acid and distearyl amine/sulfuric acid prills, and thus a simple, single compartment unit dose article can be used. Also, a more stable liquid STW composition containing the SCA and with the perfume in microcapsules can be used in a standard plastic bottle or other container. In one embodiment, the perfume microcapsule is friable. In another embodiment, the perfume microcapsule is moisture-activated.

E. Solvents

Solvents are useful for fluidizing the fabric softening compositions of the present invention, and may provide good dispersibility, and in some embodiments, provide a clear or translucent composition. Suitable solvents of the present invention can be water-soluble or water-insoluble. Non-limiting examples include ethanol, propanol, isopropanol, n-propanol, n-butanol, t-butanol, propylene glycol, 1,3-propanediol, ethylene glycol, diethylene glycol, dipropylene glycol, 1,2,3-propanetriol, propylene carbonate, phenylethyl alcohol, 2-methyl 1,3-propanediol, hexylene glycol, glycerol, sorbitol, polyethylene glycols, 1,2-hexanediol, 1,2-pentanediol, 1,2-butanediol, 1,4 butanediol, 1,4-cyclohexanedimethanol, pinacol, 1,5-hexanediol, 1,6-hexanediol, 2,4-dimethyl-2,4-pentanediol, 2,2,4-trimethyl-1,3-pentanediol (and ethoxylates), 2-ethyl-1,3-hexanediol, phenoxyethanol (and ethoxylates), glycol ethers such as butyl carbitol and dipropylene glycol n-butyl ether, ester solvents such as dimethyl esters of adipic, glutaric, and succinic acids, hydrocarbons such as decane and dodecane, or combinations thereof. In one embodiment, the composition is free or substantially free of one or more of the above-identified solvents.

Other examples of solvents include so called "principal solvents" preferably having a ClogP of from about −2.0 to about 2.6, more preferably from about −1.7 to about 1.6, as defined hereinafter, typically at a level that is less than about 80%, preferably from about 10% to about 75%, more preferably from about 30% to about 70% by weight of the composition. The "calculated logP" (ClogP) is determined by the fragment approach of Hansch and Leo (cf., A. Leo, in Comprehensive Medicinal Chemistry, Vol. 4, C. Hansch, P. G. Sammens, J. B. Taylor and C. A. Ramsden, Eds., p. 295, Pergamon Press, 1990. Principle solvents or principal solvent systems are described at U.S. Pat. Nos. 6,323,172; 6,369,025; and 5,747,443. The level of aqueous or aqueous plus solvent carrier may generally constitute the balance of the present compositions.

It will be recognized that solvents can be in solid form at room temperature and are not required to be liquids; for example, 1,4-cyclohexanedimethanol is a solid at 25° C. In addition, surface active materials can be solvents, preferably nonionic or anionic surfactants. Especially preferred are alcohol ethoxylates. Additionally, free fatty acids, fatty acid soaps, fatty triglycerides, and fatty amines, amides, alcohols can also be solvents. Especially preferred are materials that are liquid at room temperature comprised of shorter chain length, unsaturated, and/or branched fatty acid moieties.

F. Thickeners and Structurants

Compositions of the present invention may contain a structurant or structuring agent. Structurants can also build viscosity to produce a preferred liquid gel product form. Suitable levels of this component are in the range from about 0% to 20%, preferably from 0.1% to 10%, and even more preferably from 0.1% to 3% by weight of the composition. The structurant serves to stabilize the silicone polymer in the inventive compositions and to prevent it from coagulating and/or creaming. This is especially important when the inventive compositions have fluid form, as in the case of liquid or the gel-form STW compositions.

Structurants suitable for use herein can be selected from thickening stabilizers. These include gums and other similar polysaccharides, for example gellan gum, carrageenan gum, xanthan gum, Diutan gum (ex. CP Kelco) and other known types of thickeners and rheological additives such as Rheovis CDP (ex. Ciba Specialty Chemicals), Alcogum L-520 (ex. Alco Chemical), and Sepigel 305 (ex. SEPPIC).

One preferred structurant is a crystalline, hydroxyl-containing stabilizing agent, more preferably still, a trihydroxystearin, hydrogenated oil or a derivative thereof.

Without intending to be limited by theory, the crystalline, hydroxyl-containing stabilizing agent is a nonlimiting example of a "thread-like structuring system." "Thread-like Structuring System" as used herein means a system comprising one or more agents that are capable of providing a chemical network that reduces the tendency of materials with which they are combined to coalesce and/or phase split. Examples of the one or more agents include crystalline, hydroxyl-containing stabilizing agents and/or hydrogenated jojoba. Surfactants are not included within the definition of the thread-like structuring system. Without wishing to be bound by theory, it is believed that the thread-like structuring system forms a fibrous or entangled threadlike network in-situ on cooling of the matrix. The thread-like structuring system has an average aspect ratio of from 1.5:1, preferably from at least 10:1, to 200:1.

The thread-like structuring system can be made to have a viscosity of 0.002 $m^2/s$ (2,000 centistokes at 20° C.) or less at an intermediate shear range (5 $s^{-1}$ to 50 $s^{-1}$) which allows for the pouring of the STW composition out of a standard bottle, while the low shear viscosity of the product at 0.1 $s^{-1}$ can be at least 0.002 $m^2/s$ (2,000 centistokes at 20° C.) but more preferably greater than 0.02 $m^2/s$ (20,000 centistokes at 20° C.). A process for the preparation of a thread-like structuring system is disclosed in WO 02/18528.

Other preferred stabilizers are uncharged, neutral polysaccharides, gums, celluloses, and polymers like polyvinyl alcohol, polyacrylamides, polyacrylates and co-polymers, and the like.

G. Water

In one embodiment, the level of water in the STW compositions is relatively high, for example at least about 50%, preferably at least about 60%, and more preferably at least about 70% water. These are generally for packaging in a single compartment plastic bottle or container, or in a dual compartment, dual pour plastic bottle or container combined with another fabric care composition, for example, a liquid detergent. In another embodiment the level of water in highly concentrated STW compositions of the present invention is generally low, less than about 20% water, alternatively less than about 13%, alternatively less than about 10%, alternatively less than about 5%, alternatively even about zero, alternatively from about 1% to about 20%, by weight of the composition. Generally, some water is advantageous from about 8% to about 12% to prevent rigidity of a water soluble film, especially polyvinyl alcohol films used to encapsulate highly concentrated STW compositions to form a unit dose. High water levels can cause the water soluble films used (for example, polyvinyl alcohol) to encapsulate said compositions of the present invention to leak or start to dissolve or disintegrate prematurely, either in the manufacturing process, during shipping/handling, or upon storage. However, it has been found that a low level of water can be desirable as medium for adding water-soluble dyes to the composition to give it an attractive color and to distinguish between compositions with different perfumes and/or added fabric care benefits. Oil soluble dyes can be used without the use of water medium but are not preferred since they can cause fabric staining to occur. In one embodiment a low level of water is needed to effectively hydrate a polymer such as cationic guar gum and/or a structuring agent in the context of a unit dose article with a water soluble film.

H. Optional Ingredients

The STW compositions of the present invention may comprise one or more optional ingredients. In yet another embodiment, the composition is free or substantially free of one or more optional ingredients.

Fatty Acid

Fatty acid may be incorporated into STW compositions as a softening active. In one embodiment, fatty acid may include those containing from about 12 to about 25, preferably from about 13 to about 22, more preferably from about 16 to about 20, total carbon atoms, with the fatty moiety containing from about 10 to about 22, preferably from about 12 to about 18, more preferably from about 14 (midcut) to about 18, carbon atoms. The fatty acids of the present invention may be derived from (1) an animal fat, and/or a partially hydrogenated animal fat, such as beef tallow, lard, etc.; (2) a vegetable oil, and/or a partially hydrogenated vegetable oil such as canola oil, safflower oil, peanut oil, sunflower oil, sesame seed oil, rapeseed oil, cottonseed oil, corn oil, soybean oil, tall oil, rice bran oil, palm oil, palm kernel oil, coconut oil, other tropical palm oils, linseed oil, tung oil, etc. ; (3) processed and/or bodied oils, such as linseed oil or tung oil via thermal, pressure, alkali-isomerization and catalytic treatments; (4) a mixture thereof, to yield saturated (e.g. stearic acid), unsaturated (e.g. oleic acid), polyunsaturated (linoleic acid), branched (e.g. isostearic acid) or cyclic (e.g. saturated or unsaturated α-disubstituted cyclopentyl or cyclohexyl derivatives of polyunsaturated acids) fatty acids. Non-limiting examples of fatty acids (FA) are listed in U.S. Pat. No. 5,759,990 at col 4, lines 45-66.

Mixtures of fatty acids from different fat sources can be used, and in some embodiments preferred. Nonlimiting examples of FA's that can be blended, to form FA's of this invention are as follows:

| | Fatty Acyl Group | | |
|---|---|---|---|
| | $FA^1$ | $FA^2$ | $FA^3$ |
| $C_{14}$ | 0 | 0 | 1 |
| $C_{16}$ | 3 | 11 | 25 |
| $C_{18}$ | 3 | 4 | 20 |
| C14:1 | 0 | 0 | 0 |
| C16:1 | 1 | 1 | 0 |
| C18:1 | 79 | 27 | 45 |
| C18:2 | 13 | 50 | 6 |
| C18:3 | 1 | 7 | 0 |
| Unknowns | 0 | 0 | 3 |
| Total | 100 | 100 | 100 |
| IV | 99 | 125-138 | 56 |
| cis/trans (C18:1) | 5-6 | Not Available | 7 |
| TPU | 14 | 57 | 6 |

$FA^1$ is a partially hydrogenated fatty acid prepared from canola oil, $FA^2$ is a fatty acid prepared from soybean oil, and $FA^3$ is a slightly hydrogenated tallow fatty acid.

It is preferred that at least a majority of the fatty acid that is present in the fabric softening composition of the present invention is unsaturated, e.g., from about 40% to 100%, preferably from about 55% to about 99%, more preferably from about 60% to about 98%, by weight of the total weight of the fatty acid present in the composition, although fully saturated and partially saturated fatty acids can be used. As such, it is preferred that the total level of polyunsaturated fatty acids (TPU) of the total fatty acid of the inventive composition is preferably from about 0% to about 75% by weight of the total weight of the fatty acid present in the composition.

The cis/trans ratio for the unsaturated fatty acids may be important, with the cis/trans ratio (of the C18:1 material) being from at least about 1:1, preferably at least about 3:1, more preferably from about 4:1, and even more preferably from about 9:1 or higher.

The unsaturated fatty acids preferably have at least about 3%, e.g., from about 3% to about 30% by weight, of total weight of polyunsaturates.

Typically, one would not want polyunsaturated groups in actives since these groups tend to be much more unstable than even monounsaturated groups. The presence of these highly unsaturated materials makes it desirable, and for the preferred higher levels of polyunsaturation, highly desirable, that the fatty acids of the present invention herein contain antibacterial agents, antioxidants, chelants, and/or reducing materials to protect from degradation. While polyunsaturation involving two double bonds (e.g., linoleic acid) is favored, polyunsaturation of three double bonds (linolenic acid) is not. It is preferred that the C18:3 level in the fatty acid be less than about 3%, more preferably less than about 1%, and even more preferably less than about 0.1%, by weight of the total weight of the fatty acid present in the composition of the present invention. In one embodiment, the fatty acid present in the composition is essentially free, preferably free of a C18:3 level.

Branched fatty acids such as isostearic acid are preferred since they may be more stable with respect to oxidation and the resulting degradation of color and odor quality.

The Iodine Value or "IV" measures the degree of unsaturation in the fatty acid. In one embodiment of the invention, the fatty acid has an IV preferably from about 40 to about 140, more preferably from about 50 to about 120 and even more preferably from about 85 to about 105.

Clays

In one embodiment of the invention, the fabric care composition may comprise a clay as a fabric care active. In one embodiment clay can be a softener or co-softeners with another softening active, for example, silicone. Preferred clays include those materials classified geologically smectites and are described in U.S. Pat. Appl. Publ. 20030216274 A1, to Valerio Del Duca, et al., published Nov. 20, 2003, paragraphs 107-120.

Other suitable clays are described U.S. Pat. Nos. 3,862,058; 3,948,790; 3,954,632; 4,062,647; and U.S. Patent Application Publication No. 20050020476A1 to Wahl, et. al., page 5 and paragraph 0078 through page 6 and paragraph 0087.

Perfume

The STW compositions of the present invention can optionally further comprise perfume, typically at a level of from about 0.1% to about 10%, preferably from about 1% to about 6%, and more preferably from about 1% to about 4%, by weight of the composition. Preferably, the perfume comprises enduring perfume ingredients that have a boiling point of about 250° C. or higher and a ClogP of about 3.0 or higher, more preferably at a level of at least about 25%, by weight of the perfume. Suitable perfumes, perfume ingredients, and perfume carriers are described in U.S. Pat. No. 5,500,138; and US 20020035053 A1

In one embodiment, the perfume comprises a perfume microcapsule. Suitable perfume microcapsules and perfume nanocapsules include: US 2003215417 A1; US 2003216488 A1; US 2003158344 A1; US 2003165692 A1; US 2004071742 A1; US 2004071746 A1; US 2004072719 A1; US 2004072720 A1; EP 1393706 A1; US 2003203829 A1; US 2003195133 A1; US 2004087477 A1; US 20040106536 A1; U.S. Pat. No. 6,645,479; U.S. Pat. No. 6,200,949; U.S. Pat. No. 4,882,220; U.S. Pat. No. 4,917,920; U.S. Pat. No. 4,514,461; US Re. 32713; U.S. Pat. No. 4,234,627. For purposes of the present invention, the term "perfume microcapsules" describes both perfume microcapsules and perfume nanocapsules.

In yet another embodiment, the STW composition of the present invention comprises odor control agents. Such agents include those described in U.S. Pat. No. 5,942,217: Uncomplexed cyclodextrin compositions for odor control", granted Aug. 24, 1999. Other agents suitable odor control agents include those described in the following: U.S. Pat. No. 5,968,404, U.S. Pat. No. 5,955,093; U.S. Pat. No. 6,106,738; U.S. Pat. No. 5,942,217; and U.S. Pat. No. 6,033,679.

In one embodiment, the fabric care benefit is dry fabric odor or fragrance to fabric, and the fabric care benefit agent is a perfume. The perfume can be delivered to the wash via a unit dose, such composition being contained in a water soluble film such as polyvinyl alcohol. Typically, the perfume is preferably mixed with a dispersing solvent, a surfactant or mixture thereof, but can be used alone. An example of a dispersing solvent is dipropylene glycol or other glycols or solvatropes or fatty alcohol ethoxylates or mixtures thereof. The surfactant can be any surfactant or emulsifying agent previously mentioned used at a non-detersive level if administered in a 64-65 liter basin of an automatic washing machine of water. The concentration of perfume in the dispersing solvent can be from about 5% to about 95% perfume, preferably from about 15% to about 75% perfume, and more preferably from about 20% to about 50% perfume. In forming a unit dose article, for example with PVOH film, the dose of the perfume containing composition is from about 0.1 ml to about 30 ml, alternatively from about 0.5 ml to about 15 ml, alternatively from about 1 ml to about 5 ml. These can be in the form of pouches, envelopes, sachets, or round beads.

In another embodiment, the fabric care composition of the present invention is free or essentially free of other water insoluble fabric care benefit agents such as silicones or other water insoluble softening agents.

The STW compositions can optionally further comprise a dye to impart color to the composition. Suitable dyes for the present STW compositions are FD&C Blue #1 and Liquitint colorants (ex. Milliken Chemical Company).

The STW compositions of the present composition can optionally further comprise other ingredients selected from the group consisting of bodying agents, drape and form control agents, smoothness agents, wrinkle control agents, sanitization agents, disinfecting agents, germ control agents, mold control agents, mildew control agents, antiviral agents, anti-microbials, drying agents, stain resistance agents, soil release agents, malodor control agents, fabric refreshing agents, chlorine bleach odor control agents, dye fixatives, dye transfer inhibitors, color maintenance agents, optical brighteners, color restoration/rejuvenation agents, anti-fading agents, whiteness enhancers, anti-abrasion agents, wear resistance agents, fabric integrity agents, anti-wear agents, defoamers and anti-foaming agents, rinse aids, UV protection agents for fabrics and skin, sun fade inhibitors, insect repellents, anti-allergenic agents, enzymes, water proofing agents, fabric comfort agents, water conditioning agents, shrinkage resistance agents, stretch resistance agents, and mixtures thereof.

The STW compositions of the present invention are preferably free of effective levels of detersive surfactants. Detersive surfactants, distinguished from the surfactants that are acting as emulsifiers or dispersing agents, are surfactants that are present in a composition in an amount effective to provide noticeable soil removal from fabrics. Typical detersive surfactants include anionic surfactants, such as alkyl sulfates and alkyl sulfonates, and nonionic surfactants, such as $C_8$-$C_{18}$ alcohols condensed with from 1 to 9 moles of $C_1$-$C_4$ alkylene oxide per mole of $C_8$-$C_{18}$ alcohol. Typical levels of surfactant in typical quality detergents are from about 12% to about 22%, and are used at a dosage in the range from about 90 g to about 120 g.

Preferred forms of the STW composition of the present invention are liquids and gels. The STW composition can also be in the form of a paste, semi-solid, suspension, powder, or any mixture thereof. A dual compartment article, for example a dual compartment unit dose made form PVOH film, can be comprised of the same or 2 different forms, for example a liquid/powder pouch, a liquid/liquid pouch, and a gel/powder pouch.

The STW compositions of the present invention, when added to a wash solution of a laundering process, provide a concentration of at least about 10 ppm, preferably at least about 20 ppm, preferably at least about 50 ppm, and more preferably from about 50 ppm to about 200 ppm, of fabric softening active (for example silicone) and any optional co-softening compound in the wash solution. Applicants have found that these levels are preferred to provide an effective level to provide a noticeable softness benefit. Higher softener active concentrations could provide more softness, but could also possibly create staining or spotting and unnecessary cost. However, if for example, wrinkle control of fabrics is the primary fabric care benefit, higher softening active levels (for example, silicone) could be used. The STW compositions of the present invention, when added to a wash solution of a laundering process, provide a concentration of at least about 1 ppm, preferably at least about 3 ppm, and more preferably from about 4 ppm to about 25 ppm, of coacervate in the wash solution, not including any water that may or may not be associated with the coacervate. Applicants have found that these levels of coacervate are preferred to provide an effective level to provide a noticeable softness benefit. Higher coacervate concentrations could provide more softness, but could also possibly create cleaning and/or whiteness maintenance negatives in the laundry washing process and unnecessary cost. A typical wash solution of a laundering process has a volume of about 64 liters.

The STW compositions of the present invention can be added directly, as-is, to the wash cycle, preferably as a unit dose composition. It is preferred that the film of the coating material be water-soluble, preferably made of polyvinyl alcohol or a derivative of polyvinyl alcohol. Films comprised of hydroxypropyl methylcellulose and polyethylene oxide may also be used, as well as mixtures thereof, and mixtures with PVOH. Water-insoluble films can also be used, such as polyethylene and the like, for pouching.

When a STW composition contained in a coating material comprising a film is desired, these materials may be obtained in a film or sheet form that may be cut to a desired shape or size. Specifically, it is preferred that films of polyvinyl alcohol, hydroxypropyl methyl cellulose, methyl cellulose, nonwoven polyvinyl alcohols, PVP and gelatins or mixtures be used to encapsulate the STW compositions. Polyvinyl alcohol films are commercially available from a number of sources including MonoSol LLC of Gary, Ind., Nippon Synthetic Chemical Industry Co. Ltd. Of Osaka Japan, and Ranier Specialty Chemicals of Yakima, Washington. These films may be used in varying thicknesses ranging from about 20 to about 80 microns, preferably from about 25 to about 76 microns. For purposes of the present invention, it is preferred to use a film having a thickness of about 25 to about 76 micrometers for rapid dissolution in a cold water wash. Where larger volumes of composition are to be contained in encapsulate, volumes exceeding about 25 ml, a thicker film may be desired to provide additional strength and integrity to the encapsulate. Further, it is preferred that the water-soluble films be printable and colored as desired.

Encapsulate articles such as pouches, pillows, sachets, beads, or envelopes are easily manufactured by heat-sealing multiple sheets together at their edges, leaving an opening for inserting the STW composition. This opening can then be heat-sealed after the STW composition has been introduced. Pouches can also be made by vacuum forming and sealing. The size of the film segments used will depend on the volume of composition to be encapsulated. Heat sealing is described as one preferred method for forming and sealing encapsulated articles of the present invention, but it should be recognized that the use of adhesives, mechanical bonding, and partially solvating the films with water, solvents, and mixtures thereof, are alternative preferred methods for forming encapsulated articles. One suitable method for producing an article containing a composition of the present invention is thermoforming, preferably a water soluble film. The thermoforming process consists of first placing a sheet of film over a forming mold having at least one forming cavity and heating the film so that it forms into the recess of the cavity, placing a composition of the present invention into the formed cavity, and sealing a second sheet of film across the recess to form the closed article. Articles of multiple cavities may also be thermoformed in the same manner with heat applied to additional layers of film to make an additional recess for a second compartment to contain a composition of the present invention. Similar processes describing related unit dose articles can be found in U.S. Pat. No. 6,281,183 B1, EP1126070, WO0183668, WO0183669, WO0185898, WO0183661, WO0183657, WO0183667, WO0185892, WO00208380, WO0212432, WO0220361, WO0240351, WO00183658, WO0240370, WO0160966, WO02060758, WO02060980, WO02074893, WO02057402, WO03008513, WO03008486, WO03031266, WO03045812, WO03045813, WO02060757, EP1354939, EP1375351, EP1396440, EP1431383, EP1431384, EP1340692, WO04085586. A unit dose article can also consist of the enclosed composition of the present invention shaped into a spherical bead as is described in WO 97/35537.

During the manufacture of a unit dose with a film, for example PVOH, it is useful to leave an air bubble in the pouch of a liquid composition. The air bubble is formed by slightly under filling the liquid composition into the pouch as it is being formed, for example, by vacuum. This helps prevent the liquid composition from contacting the sealing area of the film, for example when a second film is placed over the first film that is holding the liquid composition. The air bubble is from about 0.1 ml to about 10 ml in volume, alternatively from about 0.5 ml to about 5 ml. The air bubble also is a good aesthetic visual signal for the consumer that the filled pouch actually contains a liquid composition. As a visual signal, the bubble should be from about 1 mm to about 20 mm in diameter, alternatively from about 3 mm to about 10 mm.

Plasticizers

For compositions intended to be enclosed or encapsulated by a film, especially a highly water-soluble film like polyvinyl alcohol, it is desirable to incorporate the same or similar plasticizers found in the film into the fabric softener composition. This helps reduce or prevent migration of the film plasticizers into the softener composition. Loss of plasticizers from the film can cause the article to become brittle and/or lose mechanical strength over time. Typical plasticizers to include in the highly concentrated fabric softener composition are glycerin, sorbitol, 1,2 propanediol, polyethylene glycols (PEGs), and other diols and glycols and mixtures. Compositions should contain from at least about 0.1%, preferably at least about 1%, and more preferably at least about 5% to about 70% plasticizer or mixture of plasticizers.

In some embodiments, for example one contained in a water soluble film, it is necessary to choose solvents that do not compromise the physical integrity of the water soluble film. Some solvents act as plasticizers that will soften the film over time, others cause the film to become brittle over time by leaching out plasticizers from the water soluble film. The ratio of the plasticizing to non-plasticizing solvents in the formulation to be contained in the water soluble film must be balanced to uphold the physical integrity of the water soluble film over time. For example, one preferred mixture of solvents is polyethylene glycol (PEG) and glycerin in a ratio between about 4:3 to about 2:3 respectively, more preferably wherein the PEG is PEG-400. Another example is a mixture of three solvents, preferably polyethylene glycol (PEG), glycerin, and propylene glycol wherein the ratio of the PEG and glycerin is between about 4:3 to about 2:3, and the balance of the solvent composition of the formulation is made up of propylene glycol.

The present invention can also include other compatible ingredients, including those disclosed U.S. Pat. Nos.: 5,686,376; 5,536,421.

Hueing Dyes and Brighteners.

In one embodiment, the STW composition comprising a hueing dye. A preferred hueing dye is one that exhibits a hueing efficiency of at least about 20 and a wash removal value in the range of from about 50% to about 98%. Suitable hueing dyes are described in the U.S. publication for pending U.S. application Ser. No. 11/244,774 (P&G Case 9795); and U.S Pat. Publ. Nos.: 2005/0288207 A1; 2005/0287654 A1. Specific hueing dyes may include: Acid Violet 43 (Anthraquinone); Acid Violet 49 (Triphenylmethane); Acid Blue 92 (Monoazo); Liquitint Violet DD; Liquitint Violet CT; and Liquitint Violet LS (from Milliken Chemical).

In another embodiment, the STW composition of the present invention comprises a brightener. Suitable brighteners, also called optical brighteners or fluorescent whitening agents (FWAs), are more fully described in the following: (1) Ullman's Encyclopedia of Industrial Chemistry, Fifth Edition, Vol. A18, Pages 153 to 176; (2) Kirk-Othmer Encyclopedia of Chemical Technology, Volume 11, Fourth Edition;

and (3) Fluorescent Whitening Agents, Guest Editors R. Anliker and G. Muller, Georg Thieme Publishers Stuttgart (1975).

Flow Aids

The composition may comprise a flow aid. Moisture, pressure, and temperature all adversely affect powdered and granulated products. These conditions can make formulations cake, lump, bridge, and clog the process and filling equipment and result in packaging and performance problems. Additionally, powder particle size, texture, and density can affect the mixing and flowability of powders. These problems can even be manifested in the consumers' laundry process by showing up as powdery residues on clothing, especially when the consumer line dries their fabrics. Anti-caking, free-flow, powder flow aids, and carrier agents can markedly improve the flow behavior and storage stability of powder formulations.

Flow aids work by coating the surface of the powdered formula thereby reducing interparticle interactions, by interspersing and preventing interparticle interactions, and by preferentially absorbing the moisture that causes bridging between particles. Some preferred examples of particularly useful flow aids are fumed silicas (for example, Cab-o-Sils® from Cabot or Aerosils® from Degussa), precipitated silicas and silicates (for example, Sipemat® from Degussa), metal soaps such as aluminum separate, starches, polyethylene waxes, zeolites, talc, and the like. Particularly preferred are Cab-o-Sil® M5, and Sipernats® 880, 820A and D17. Flow aids can be either hydrophilic or hydrophobic, or mixtures thereof.

Packaging

One aspect of the invention provides for a laundry article comprising: (a) a container comprising at least two compartments; (b) wherein at least in one compartment comprises any one composition of the present invention. In another embodiment, at least one compartment comprises a detersive surfactant composition. The term "detersive surfactant composition" is used herein the broadest sense to include any composition suitable to clean fabric, preferably in a washing machine. In yet another embodiment, the compartment comprising a composition of the present invention is different than the compartment comprising the detersive surfactant composition.

Any container comprising at least two compartments may be suitable. Non-limiting examples of such a container are described in include: U.S. Pat. No. 4,765,514, U.S. Pat. Appl. Pub. Nos.:2002/0077265 A1; and 2002/0074347 A1.

If the laundry article is a unit dose wherein the composition or compositions are encapsulated with a water soluble film (for example PVOH film), then the size of the article is from about 0.5 g to about 90 g, alternatively from about 5 g to about 50 g, and preferable from about 10 g to about 40 g.

EXAMPLES

Liquid Compositions for a Bottle Container

Example I

| Component | Wt. % | Grams/dose |
|---|---|---|
| PDMS (100K cSt) | 20.00 | 6.00 |
| Neodol 25-3[1] | 5.00 | 1.50 |
| Sodium Lauryl Sulfate (30%) | 2.00 | 0.60 |
| Perfume | 2.57 | 0.77 |
| Liquitint Blue Dye[2] (1%) | 0.15 | 0.045 |

-continued

| Component | Wt. % | Grams/dose |
|---|---|---|
| Kathon[3] (100%) | 3 ppm | 0.00009 |
| DI Water | 70.28 | 21.08 |
| Total | 100.00 | 30.00 |

Example II

| Component | Wt. % | Grams/dose |
|---|---|---|
| PDMS (100K cSt) | 20.00 | 6.00 |
| Neodol 25-3[1] | 5.00 | 1.50 |
| Sodium Lauryl Sulfate (30%) | 2.00 | 0.60 |
| Perfume | 2.57 | 0.77 |
| Liquitint Blue Dye[2] (1%) | 0.15 | 0.045 |
| Cationic Guar Gum[4] | 0.67 | 0.20 |
| Kathon (100%)[3] | 3 ppm | 0.00009 |
| DI Water | 69.61 | 20.88 |
| Total | 100.00 | 30.00 |

Example III

| Component | Wt. % | Grams/dose |
|---|---|---|
| Wacker-Belsil ADM 1100 Silicone[5] | 13.33 | 3.0000 |
| C25AE1.1S[6] (50%) | 3.25 | 0.7313 |
| HLAS (90%)[7] | 0.75 | 0.1688 |
| Neodol 23-9[8] (100%) | 1.50 | 0.3375 |
| Fatty Acid[9] | 1.32 | 0.2970 |
| Cationic Guar Gum[4] | 0.89 | 0.2000 |
| HCl (25%) | 0.20 | 0.0450 |
| Kathon[3] (1.5%) | 0.047 | 0.0105 |
| Liquitint Blue Dye[2] (1%) | 0.15 | 0.0345 |
| DI Water | 78.56 | 17.6755 |
| Total | 100.00 | 22.50 |

Example IV

| Component | Wt. % | Grams/dose |
|---|---|---|
| PDMS @100K cSt | 13.33 | 3.0000 |
| C25AE1.1S[6] (50%) | 6.34 | 1.4265 |
| HLAS[7] (90%) | 1.98 | 0.4455 |
| Neodol 23-9[8] (100%) | 1.50 | 0.3375 |
| Fatty Acid[9] | 1.32 | 0.2970 |
| Cationic Guar Gum[4] | 0.45 | 0.1013 |
| HCl (25%) | 0.04 | 0.0100 |
| Kathon[3] (1.5%) | 0.020 | 0.0045 |
| Liquitint Blue Dye[2] (1%) | 0.15 | 0.0345 |
| DI Water | 74.87 | 16.8432 |
| Total | 100.00 | 22.50 |

Example V

| Component | Wt. % | Grams/dose |
|---|---|---|
| PDMS @100K cSt | 13.33 | 3.0000 |
| SCA[10] | 8.89 | 2.0000 |
| C25AE1.1S[6] (100%) | 6.34 | 1.4265 |
| HLAS[7] (90%) | 1.98 | 0.4455 |
| Neodol 23-9[8] (100%) | 1.50 | 0.3375 |
| Cationic Guar Gum[4] | 0.45 | 0.1013 |
| Perfume | 3.42 | 0.7700 |
| HCl (25%) | 0.04 | 0.0100 |
| Kathon[3] (1.5%) | 0.020 | 0.0045 |
| Liquitint Blue Dye[2] (1%) | 0.15 | 0.0345 |
| DI Water | 63.88 | 14.3702 |
| Total | 100.00 | 22.50 |

Example VI

| Component | Wt. % | Grams/dose |
|---|---|---|
| PDMS @100K cSt | 13.33 | 3.0000 |
| SCA[10] | 8.89 | 2.0000 |
| C25AE1.1S[6] (100%) | 4.00 | 0.9000 |
| HLAS[7] (90%) | 1.50 | 0.3375 |
| Neodol 23-9[8] (100%) | 1.50 | 0.3375 |
| Cationic Guar Gum[4] | 0.45 | 0.1013 |
| Sepigel 305[12] | 1.75 | 0.3938 |
| HCl (25%) | 0.04 | 0.0100 |
| Kathon[3] (1.5%) | 0.020 | 0.0045 |
| Liquitint Blue Dye[2] (1%) | 0.15 | 0.0345 |
| DI Water | 68.37 | 15.3810 |
| Total | 100.00 | 22.50 |

Example VII

| Component | Wt. % | Grams/dose |
|---|---|---|
| PDMS @100K cSt | 26.67 | 6.0000 |
| SCA[10] | 8.89 | 2.0000 |
| C25AE1.1S[6] (100%) | 5.00 | 1.125 |
| HLAS[7] (90%) | 1.50 | 0.3375 |
| Neodol 23-9[8] (100%) | 1.50 | 0.3375 |
| Sepigel 305[12] | 1.75 | 0.3938 |
| Kathon[3] (1.5%) | 0.020 | 0.0045 |
| Liquitint Blue Dye[2] (1%) | 0.15 | 0.0345 |
| DI Water | 54.52 | 12.267 |
| Total | 100.00 | 22.50 |

Example VIII

| Component | Wt. % | Grams/dose |
|---|---|---|
| PDMS @100K cSt | 6.67 | 3.0000 |
| SCA[10] | 4.44 | 2.0000 |
| C25AE1.1S[6] (100%) | 5.00 | 2.2500 |
| Neodol 23-9[8] (100%) | 1.00 | 0.4500 |

-continued

| Component | Wt. % | Grams/dose |
|---|---|---|
| Cationic Guar Gum[4] | 0.22 | 0.1000 |
| Alcogum L-520[13] (20%) | 4.500 | 2.0250 |
| Perfume | 1.222 | 0.5500 |
| HCl | 0.02 | 0.0090 |
| NaOH | 0.07 | 0.0320 |
| DC-1520 Antifoam[14] (20%) | 0.10 | 0.0450 |
| Kathon[3] (1.5%) | 0.030 | 0.0135 |
| Liquitint Blue Dye[2] (5%) | 0.13 | 0.0585 |
| DI Water | 76.60 | 34.4670 |
| Total | 100.00 | 45.00 |

Example IX

| Component | Wt. % | Grams/dose |
|---|---|---|
| PDMS @100K cSt | 3.33 | 3.0000 |
| SCA[10] | 2.22 | 2.0000 |
| C25AE1.1S[6] (100%) | 6.00 | 5.4000 |
| HLAS (90%)[7] | 0.83 | 0.7470 |
| Neodol 23-9[8] (100%) | 1.00 | 0.9000 |
| Cationic Guar Gum[4] | 0.11 | 0.0990 |
| Thickener[11] | 15.000 | 13.5000 |
| Perfume | 0.856 | 0.7700 |
| HCl (25%) | 0.04 | 0.0360 |
| Kathon[3] (1.5%) | 0.040 | 0.0360 |
| Liquitint Blue Dye[2] (1%) | 0.13 | 0.1200 |
| DI Water | 70.45 | 63.3920 |
| Total | 100.00 | 90.00 |

An article of manufacture is made by placing the STW composition of Example IX in one compartment of a dual compartment, dual pour polyethylene bottle. In the other compartment is placed Liquid Tide®.

Example X

| Component | Wt. % | Grams per dose |
|---|---|---|
| PDMS @100K cSt | 6.67 | 3.0000 |
| SCA[10] | 4.44 | 2.0000 |
| C25AE1.1S[6] (100%) | 5.00 | 2.2500 |
| HLAS[7] (100%) | 0.75 | 0.3375 |
| Neodol 23-9 (100%) | 1.00 | 0.4500 |
| Cationic Guar Gum[4] | 0.22 | 0.1000 |
| Alcogum L-520[13] (20%) | 3.000 | 1.3500 |
| Perfume | 1.222 | 0.5500 |
| HCl | 0.02 | 0.0090 |
| NaOH | 0.07 | 0.0320 |
| DC-1520 Antifoam[14] (20%) | 0.10 | 0.0450 |
| Kathon[3] (1.5%) | 0.030 | 0.0135 |
| Liquitint Blue Dye[2] (5%) | 0.13 | 0.0585 |
| DI Water | 77.35 | 34.8045 |
| Total | 100.00 | 45.00 |

An article of manufacture is made by placing the STW composition of Example X in one compartment a dual compartment tray. In the other compartment is placed Liquid Tide®. The STW compartment holds about 45 g and the Liquid Tide® compartment holds about 90 g.

Another article of manufacture is made by placing the STW composition of Example X in one compartment a dual compartment plastic pouch (non-water soluble). In the other compartment is placed Liquid Tide®. The STW compartment holds about 45 g and the Liquid Tide® compartment holds about 90 g.

Example XI

| Component | Wt. % | Grams/dose |
|---|---|---|
| PDMS @100K cSt | 10.00 | 3.0000 |
| SCA[10] | 6.67 | 2.0000 |
| C25AE1.1S[6] (100%) | 5.00 | 1.5000 |
| Neodol 23-9[8] (100%) | 1.00 | 0.3000 |
| Cationic Guar Gum[4] | 0.34 | 0.1000 |
| Alcogum L-520[13] (20%) | 4.500 | 1.3500 |
| Perfume | 1.750 | 0.5250 |
| Perfume Microcapsules[15] (80% loaded) | 2.190 | 0.6600 |
| HCl | 0.01 | 0.0030 |
| NaOH | 0.07 | 0.0210 |
| DC-1520 Antifoam[14] (20%) | 0.02 | 0.0060 |
| Kathon[3] (1.5%) | 0.031 | 0.0093 |
| Liquitint Blue Dye[2] (5%) | 0.13 | 0.0390 |
| DI Water | 68.29 | 20.49 |
| Total | 100.00 | 30.00 |

Compositions for Unit Dose

Example XII

| Component | Wt. % | Grams/dose |
|---|---|---|
| PDMS (100K cSt) | 30.00 | 3.00 |
| Glycerin | 63.55 | 6.35 |
| Sepigel 305[12] | 0.50 | 0.05 |
| Perfume | 5.80 | 0.58 |
| Liquitint Blue DW[2] (1%) | 0.15 | 0.02 |
| Total | 100% | 10.00 |

An article of manufacture is made of Example XII and polyvinyl alcohol (PVOH) film in which the dose is one pouch/use (about 10 g). The PVOH film used is Monosol M8630 at 3 mil thickness. The pouch is round with approximate dimensions of 20 mm height and 40 mm diameter.

Example XIV

| Component | Wt. % | Grams/dose |
|---|---|---|
| PDMS (100K cSt) | 50.0 | 12.0 |
| Glycerin | 40.5 | 9.7 |
| Plantaren 2000[16] (50%) | 5.0 | 1.2 |
| Perfume | 4.0 | 1.0 |
| Liquitint Blue Dye[2] (1%) | 0.5 | 0.1 |
| Total | 100.00 | 24.00 |

Example XV

| Component | Wt. % | Grams/dose |
|---|---|---|
| PDMS (100K cSt) | 30.0 | 6.0 |
| Glycerin | 63.3 | 12.7 |
| Plantaren 2000[16] (50%) | 3.0 | 0.6 |
| Perfume | 3.2 | 0.60 |
| Liquitint Blue Dye[2] (1%) | 0.5 | 0.1 |
| Total | 100.00 | 20.00 |

Example XVI

| Component | Wt. % | Grams/dose |
|---|---|---|
| PDMS (100K cSt) | 50.0 | 6.00 |
| Glycerin | 41.0 | 4.92 |
| Lonza PGE-10-1-L[17] | 5.0 | 0.60 |
| Perfume | 4.0 | 0.48 |
| Total | 100.00 | 12.00 |

Example XVII

| Component | Wt. % | Grams/dose |
|---|---|---|
| PDMS (100K cSt.) | 90.0 | 6.00 |
| Proplyene glycol | 5.0 | 0.33 |
| Laureth 7[18] | 5.0 | 0.33 |
| Total | 100 | 6.66 |

Example XVIII

| Component | Wt. % | Grams/dose |
|---|---|---|
| PDMS (100K cSt) | 19.99 | 3.00 |
| SCA[10] | 13.33 | 2.00 |
| C25AE1.1S[6] (100%) | 1.16 | 0.17 |
| Neodol 23-9[8] (100%) | 5.00 | 0.75 |
| Glycerin | 16.20 | 2.43 |
| Cationic Guar Gum[4] | 0.67 | 0.10 |
| Rheovis CDP[19] (100%) | 3.13 | 0.47 |
| PEG 400[20] | 14.00 | 2.10 |
| Propylene Glycol | 11.46 | 1.72 |
| HCl | 0.13 | 0.02 |
| Perfume | 3.50 | 0.53 |
| Liquitint Blue Dye[2] (5%) | 0.23 | 0.04 |
| DI Water | 11.20 | 1.68 |
| Total | 100.00 | 15.00 |

Example XIX

| Component | Wt. % | Grams/dose |
|---|---|---|
| PDMS (100K cSt) | 20.0 | 3.00 |
| SCA[10] | 13.33 | 2.0 |
| C25AE1.1S[6] (100%) | 1.16 | 0.17 |
| Neodol 23-9[7] (100%) | 5.00 | 0.75 |
| Glycerin | 16.70 | 2.51 |
| Cationic Guar Gum[4] | 0.67 | 0.10 |
| Rheovis CDP(100%)[19] | 2.5 | 0.38 |
| PEG 400[20] | 17.00 | 2.55 |
| Propylene Glycol | 11.46 | 1.72 |
| Liquitint Blue Dye[2] (5%) | 0.23 | 0.04 |
| HCl | 0.13 | 0.02 |
| DI Water | 11.82 | 1.77 |
| Total | 100.00 | 15.00 |

An article of manufacture is made by placing the STW composition of Example XIX in one compartment of a dual compartment, water soluble PVOH pouch. In the other compartment is placed a liquid detergent formula with a total water level of about 9%. The STW compartment holds about 15 g and the detergent compartment holds about 46 g.

Example XX

| Unit Dose Article - 2 compartment liquid/liquid PVOH pouch | | |
|---|---|---|
| Component | Wt. % | Grams/dose |
| First liquid side of unit dose pouch | | |
| PDMS (100K cSt) | 20.0 | 3.00 |
| SCA[10] | 13.33 | 2.0 |
| C25AE1.8S[6] (100%) | 1.16 | 0.17 |
| Neodol 23-9[8] (100%) | 5.00 | 0.75 |
| Glycerin | 16.70 | 2.51 |
| Cationic Guar Gum[4] | 0.67 | 0.10 |
| Rheovis CDP[19] (100%) | 2.5 | 0.38 |
| PEG 400[20] | 17.00 | 2.55 |
| Propylene Glycol | 11.46 | 1.72 |
| Liquitint Blue Dye[2] (5%) | 0.23 | 0.04 |
| HCl | 0.13 | 0.02 |
| DI Water | 11.82 | 1.77 |
| Total | 100.00 | 15.00 |
| Second liquid side of unit dose pouch | | |
| Perfume | 33.33 | 3.50 |
| Dipropylene Glycol | 66.67 | 7.00 |
| Total | 100.0 | 10.50 |
| Film for pouch | | |
| Polyvinyl Alcohol (M8630K[22] at 3 mil thickness) | 100.00 | 0.8 |

Example XXI

| Unit Dose Article - 2 compartment powder/liquid PVOH pouch | | |
|---|---|---|
| Components | Wt. % | Grams/dose |
| Liquid side of unit dose pouch | | |
| PDMS (100K cSt) | 20.00 | 3.00 |
| C25AE1.8S[6] (100%) | 1.16 | 0.17 |
| Neodol 23-9[8] (100%) | 5.00 | 0.75 |
| Glycerin | 22.00 | 3.30 |
| Cationic Guar Gum[4] | 0.67 | 0.10 |
| Diutan Gum[21] | 1.00 | 0.15 |
| PEG 400[20] | 23.20 | 3.48 |
| Propylene Glycol | 11.00 | 1.65 |
| Liquitint Blue Dye[2] (5%) | 0.20 | 0.03 |
| HCl | 0.13 | 0.02 |
| Perfume | 3.50 | 0.53 |
| DI Water | 12.13 | 1.82 |
| Total | 100.00 | 15.00 |
| Powder side of unit dose pouch | | |
| SCA[10] | 40.00 | 2.00 |
| Sodium Sulfate | 60.00 | 3.00 |
| Total | 100.0 | 5.00 |
| Film for pouch | | |
| Polyvinyl Alcohol (M8630K[22] at 3 mil thickness) | 100.00 | 0.64 |

Example XXII

| Unit Dose Article - 2 compartment powder/liquid PVOH pouch | | |
|---|---|---|
| Component | % Wt. | Grams/dose |
| Liquid side of unit dose pouch | | |
| PDMS (100K cSt) | 19.92 | 2.990 |
| C25AE1.8S[6] (100%) | 1.10 | 0.170 |
| Neodol 23-9[8] (100%) | 4.98 | 0.750 |
| Glycerin | 22.71 | 3.410 |
| Cationic Guar Gum[4] | 0.66 | 0.100 |
| Diutan Gum[21] | 0.25 | 0.038 |
| PEG 400[20] | 23.11 | 3.470 |
| Propylene Glycol | 10.91 | 1.640 |
| Liquitint Blue Dye[2] (5%) | 0.01 | 0.001 |
| Perfume | 3.49 | 0.520 |
| HCl | 0.06 | 0.009 |
| DI Water | 12.82 | 1.920 |
| Total | 100.0 | 15.0 |
| Powder side of unit dose pouch | | |
| SCA[10] | 50.00 | 2.00 |
| Sodium Sulfate | 50.00 | 2.00 |
| Total | 100.00 | 4.00 |
| Film for pouch | | |
| Polyvinyl Alcohol (M8630K[22] at 3 mil thickness) | 100.00 | 0.64 |

Example XXIII

| Unit Dose Article - 2 compartment powder/liquid PVOH pouch | | |
|---|---|---|
| Component | % Wt. | Grams/dose |
| Liquid side of unit dose pouch | | |
| PDMS (100K cSt) | 19.93 | 2.990 |
| C25AE1.8S[6] (100%) | 1.13 | 0.170 |
| Neodol 23-9[8] (100%) | 5.00 | 0.750 |
| Glycerin | 22.73 | 3.410 |
| Cationic Guar Gum[4] | 0.67 | 0.100 |
| Diutan Gum[21] | 0.25 | 0.038 |
| PEG 400[20] | 23.13 | 3.470 |
| Propylene Glycol | 10.93 | 1.640 |
| Liquitint Violet CT[2] | 0.0002 | 0.003 |
| Perfume | 3.47 | 0.520 |
| HCl | 0.06 | 0.009 |
| DI Water | 12.67 | 1.90 |
| Total | 100.0 | 15.0 |
| Powder side of unit dose pouch | | |
| SCA[10] | 48.55 | 2.00 |
| Sodium Sulfate | 48.55 | 2.00 |
| FWA1[23] | 2.90 | 0.12 |
| Total | 100.00 | 4.12 |
| Film for pouch | | |
| Polyvinyl Alcohol (M8630K[22] at 3 mil thickness) | 100.00 | 0.64 |

Example XXIV

| Unit Dose Article - 1 compartment liquid PVOH pouch | | |
|---|---|---|
| Component | Wt. % | Grams/dose |
| PDMS (100K cSt) | 20.00 | 3.00 |
| C25AE1.1S[6] (100%) | 1.16 | 0.17 |
| Neodol 23-9[8] (100%) | 5.00 | 0.75 |
| Glycerin | 19.00 | 2.85 |
| Cationic Guar Gum[4] | 0.66 | 0.10 |
| Rheovis CDP[19] (100%) | 2.70 | 0.41 |
| PEG 400[20] | 20.00 | 3.00 |
| Propylene Glycol | 11.00 | 1.65 |
| FWA2[24] | 0.40 | 0.06 |
| Liquitint Violet CT[2] | 0.003 | 0.0005 |
| Monoethanolamine | 1.28 | 0.19 |
| HCl | 1.30 | 0.20 |
| Perfume | 3.50 | 0.53 |
| DI Water | 14.00 | 2.10 |
| Total | 100.00 | 15.00 |
| Film for pouch | | |
| Polyvinyl Alcohol (M8630K[22] at 3 mil thickness) | 100.00 | 0.43 |

Example XXV

| Unit Dose Article - 1 compartment liquid PVOH pouch | | |
|---|---|---|
| Component | Wt. % | Grams/dose |
| PDMS (100K cSt Silicone) | 10.00 | 1.50 |
| C25AE1.8S (100%) | 0.60 | 0.09 |
| Neodol 23-9 | 5.00 | 0.75 |
| Glycerin | 31.67 | 4.75 |
| CGG - NHance 3196 | 0.67 | 0.10 |
| Xanthan Gum | 0.35 | 0.05 |
| PEG 400 | 23.20 | 3.48 |
| Propylene Glycol | 11.20 | 1.68 |
| Liquitint Dye[25] | 0.087 | 0.013 |
| HCl | 0.10 | 0.02 |
| Perfume Microcapsules[26] | 4.73 | 0.71 |
| DI Water | 12.40 | 1.86 |
| Total | 100.00 | 15.00 |
| Film for pouch | | |
| Polyvinyl Alcohol (M8630K[22] at 3 mil thickness) | 100.00 | 0.43 |

Example XXVI

| Unit Dose Article - 2 compartment powder/liquid PVOH pouch | | |
|---|---|---|
| Components | Wt. % | Grams/dose |
| Liquid side of unit dose pouch | | |
| PDMS (100K cSt) | 20.00 | 3.00 |
| C25AE1.8S[6] (100%) | 1.16 | 0.17 |
| Neodol 23-9[8] (100%) | 5.00 | 0.75 |
| Glycerin | 22.00 | 3.30 |
| Cationic Guar Gum[4] | 0.67 | 0.10 |
| Diutan Gum[21] | 1.00 | 0.15 |
| PEG 400[20] | 23.20 | 3.48 |
| Propylene Glycol | 11.00 | 1.65 |
| Liquitint Blue Dye[2] (5%) | 0.20 | 0.03 |
| HCl | 0.13 | 0.02 |
| Perfume | 3.50 | 0.53 |
| DI Water | 12.13 | 1.82 |
| Total | 100.00 | 75.00 |
| Powder side of unit dose pouch | | |
| SCA[10] | 83.30 | 2.00 |
| Flow Aid[27] | 16.70 | 0.40 |
| Total | 100.0 | 2.40 |
| Film for pouch | | |
| Polyvinyl Alcohol (M8630K[22] at 3 mil thickness) | 100.00 | 0.64 |

Example XXVII

| Unit Dose Article - 2 compartment powder/liquid PVOH pouch | | |
|---|---|---|
| Components | Wt. % | Grams/dose |
| Liquid side of unit dose pouch | | |
| PDMS (100K cSt) | 20.00 | 3.00 |
| C25AE1.8S[6] (100%) | 1.16 | 0.17 |
| Neodol 23-9[8] (100%) | 5.00 | 0.75 |
| Glycerin | 22.00 | 3.30 |
| Cationic Guar Gum[4] | 0.67 | 0.10 |
| Diutan Gum[21] | 1.00 | 0.15 |
| PEG 400[20] | 23.20 | 3.48 |
| Propylene Glycol | 11.00 | 1.65 |
| Liquitint Blue Dye[2] (5%) | 0.20 | 0.03 |
| HCl | 0.13 | 0.02 |
| Perfume | 3.50 | 0.53 |
| DI Water | 12.13 | 1.82 |
| Total | 100.00 | 15.00 |
| Powder side of unit dose pouch | | |
| SCA[10] | 98.04 | 2.00 |
| Flow Aid[27] | 1.96 | 0.04 |
| Total | 100.0 | 2.04 |
| Film for pouch | | |
| Polyvinyl Alcohol (M8630K[22] at 3 mil thickness) | 100.00 | 0.64 |

Example XXVIII

| Unit Dose Article - 2 compartment powder/liquid PVOH pouch | | |
|---|---|---|
| Components | Wt. % | Grams/dose |
| Liquid side of unit dose pouch | | |
| PDMS (100K cSt) | 20.00 | 3.00 |
| C25AE1.8S[6] (100%) | 1.16 | 0.17 |
| Neodol 23-9[8] (100%) | 5.00 | 0.75 |
| Glycerin | 22.00 | 3.30 |
| Cationic Guar Gum[4] | 0.67 | 0.10 |
| Diutan Gum[21] | 1.00 | 0.15 |
| PEG 400[20] | 23.20 | 3.48 |
| Propylene Glycol | 14.50 | 2.18 |
| Liquitint Blue Dye[2] (5%) | 0.20 | 0.03 |
| HCl | 0.13 | 0.02 |
| DI Water | 12.13 | 1.82 |
| Total | 100.00 | 15.00 |
| Powder side of unit dose pouch | | |
| SCA[10] | 72.73 | 2.00 |
| Perfume Microcapsules[26] | 25.82 | 0.71 |
| Flow Aid[27] | 1.45 | 0.04 |
| Total | 100.0 | 2.75 |
| Film for pouch | | |
| Polyvinyl Alcohol (M8630K[22] at 3 mil thickness) | 100.00 | 0.64 |

HIPE

Example XXIX

| Component | Wt. % |
|---|---|
| PDMS (100K cSt) | 90.00 |
| C25AE1.8S[6] (100%) | 1.25 |
| Ethanol | 0.20 |
| DI Water | 8.55 |
| Total | 100.00 |

[1]alkyl $C_{12}$-$C_{15}$ ethoxylated alcohol with an average of 3 moles EO (from Shell)

[2]available from Milliken Chemical

[3]KATHON ® CG preservative (available from Rohm and Haas Company)

[4]N-Hance ® 3196 from Aqualon. Alternatively, Magnafloc 370 (from Ciba Specialty Chemicals), Lupamin (from BASF), Polymer LK 400, or mixtures thereof can be used.

[5]amino functional Silicone from Wacker with about 0.14% nitrogen.

[6]sodium alkyl ($C_{12}$-$C_{15}$) ether sulfate with an average of 1.1 or 1.8 mole EO, as indicated. Raw material contains 50% surfactant paste, 42% water, and 8% ethanol.

[7]C11.8 linear alkylbenzene sulfonic acid

[8]alkyl C12-C13 ethoxylated alcohol with an average of 9 moles EO (from Shell)

[9]fatty acid is nominally (in weight percent): 50% C12, 17% C14, 9% C16, 2.5% C18, and 17% C18:1 (oleic).

[10]SCA are prills of nominally 70% distearyl amine + cumene sulfonic acid ion pair and 30% bis (distearyl) ammonium sulfate with an Rotap median particle size of about 95 microns from Degussa.

[11]hydrogenated castor oil (Thixcin ® from Elementis Specialties) 4%, HLAS 16%, NaOH 4%, H3BO3 0.25%, and the balance is water.

[12]Sepigel ® 305 is a proprietary mixture of polyacrylamide, C13-14 isoparaffin, and laureth-7 from SEPPIC

[13]Alcogum L-520 is a polymethylmethacrylate copolymer from Alco Chemical, a National Starch Company. It has a DMAM backbone (dimethyl amino methacrylate polymer) with a nonionic hydrophobic associative monomer (methacrylate ester monomer).

[14]silicone emulsion with silica antifoam from Dow Corning

[15]microcapsules are from Aveka and are made of a urea formaldehyde shell and have a loading of 80% perfume.

[16]Plantaren 2000 is a alkyl polyglycoside surfactant from Cognis.

[17]Lonza PEG-10-1-L is polyglyceryl 10 laurate.

[18]Laureth-7 is the polyethylene glycol ether of lauryl alcohol with an average of 7 moles of ethoxylation.

[19]Rheovis CDP is a cationic slightly cross-linked acrylic-based copolymer supplied by Ciba Specialty Chemicals. It is a microparticulate thickening system supplied as a 50% active dispersion in mineral oil and contains a non-ionic activating surfactant.

[20]polyethylene glycol 400

[21]Diutan Gum is a 6-ring anionic polysaccharide from CP Kelco, industrial grade K1C626. It is a natural high molecular weight gum produced by carefully controlled aerobic fermentation of *Sphingomonas* species.

[22]polyvinyl alcohol film supplied by MonoSol LLC.

[23]FWA1 is a brightener, disodium 4,4'-bis-(2-sulfostyryl)biphenyl, sold as Tinopal CBS-X (from Ciba Specialty Chemicals).

[24]FWA2 is a brightener, disodium 4,4'-bis{[4-anilino-6-morpholino-s-triazin-2-yl}-amino}-2,2'-stilbenedisulfonate, sold as Tinopal AMS-GX (from Ciba Specialty Chemicals).

[25]Hueing dyes from Milliken Chemical. Preferably Liquitint Violet CT or Liquitint Violet LS or mixtures thereof.

[26]Perfume microcapsules are from Appleton and are made of a urea formaldehyde shell and have a loading of 80% perfume. Alternative perfume capsules available from Chemitech and Appleton.

[27]Flow aid is a Sipernat from Degussa, preferably 88, 820A, D17 or mixtures thereof.

[28]Flow aid is a Cab-o-Sil from Cabot or an Aerosil from Degussa, preferably Cab-o-Sil M5.

Processing Steps for Example XXIII

Premixes:

1. Prepare guar premix: combine 3% N-Hance 3196 guar powder, 50% propylene glycol and 47% DI water in beaker and mix 30 minutes, drop pH to 6-7 with 25% HCL, mix an additional 15 min.
2. Prepare Diutan gum premix: combine 0.54% Diutan gum powder, 49.3% glycerin and 50.16% PEG 400 in beaker and mix until all powder is dissolved (about 1 to 2 hrs.).
3. Prepare PDMS HIPE: combine 90% 100K PDMS, 2.5% AEI.8S surfactant, and 7.5% DI water and mix with speed mixer until emulsified (check dispersion in water to ensure HIPE formation).

Procedure:

1. Combine 0.63% AE1.8S and 5% Neodol.
2. Add 22% guar premix and stir until smooth—this is the coacervate.
3. Add 22.2% PDMS HIPE and 46.11% Diutan gum premix.
4. Overhead mix with IKA mixer (Janke & Kunkel IKA-Werk Labortechnik Model RW 20 DZM) on 800-1000 rpm for 15-30 min.
5. Check pH and lower with 25% HCL to pH 5 to 6 if needed.
6. Add perfume oil and continue stirring an additional 15 min.
7. Add dye and stir until homogeneous.

Pouches:

Liquid—15 g of the above formula is pouched in PVOH film as the liquid compartment.

Powder—5 g of a dry mix of SCA and sodium sulfate (1:1) is the powder compartment.

Film—about 0.64 g total of polyvinyl alcohol film, Monosol 8630K at 3 mil thickness from MonSol LLC.

Example XXX

Two compartment PVOH pouch containing a detergent and fabric softener in a first compartment and a static control agent in a second compartment.

Detergent:

| INGREDIENTS | A[3] Wt % | B[3] Wt % |
|---|---|---|
| Linear alkylbenzene sulfonic acid | — | 5.0 |
| Alkyl ethoxylates | 58.2 | 50.8 |
| Alkylamidopropyl amine | 1.7 | 3.3 |
| Citric acid | 1.5 | 3.2 |
| DTPMP[1] | 0.9 | |
| DTPA[3] | — | 0.3 |
| Amine ethoxylate polymers | 3.0 | 3.7 |
| 1,2-propanediol | 22.7 | 17.5 |
| Monoethanolamine | to pH 8.0 | to pH 8.0 |
| Protease | — | 1.8 |
| Amylase | — | 0.4 |
| Lipase | — | 0.1 |
| Formic acid | 1.0 | 1.0 |
| Calcium chloride | 0.1 | — |
| Calcium and sodium formate | — | 0.5 |
| Fluorescent whitening agent | 0.25 | 0.25 |

-continued

| INGREDIENTS | A[3] Wt % | B[3] Wt % |
|---|---|---|
| Perfume | 0.5 | — |
| Dye | 0.002 | 0.002 |
| Water | Balance | Balance |
| Dose (grams per load) | 50 | 50 |

[1]diethylenetriaminepentakismethylenephosphonic acid, sodium salt
[2] diethylenetriaminepentaacetic acid, sodium salt
[3]compact formula, packaged as a unitized dose in polyvinyl alcohol film Coacervate

| INGREDIENTS | C Wt % |
|---|---|
| PDMS (100K cSt) | 44.0 |
| Cationic guar gum[1] | 1.5 |
| C251.8AES[2] (100%) | 1.25 |
| HCl | To pH 7 to 8 |
| Water | Balance |
| Dose (grams per load) | 6.8 |

[1]N-Hance 3196 from Aqualon
[2]sodium alkyl (C12-15) ether sulfate with an average of 1.1 or 1.8 mole EO, as indicated. Raw material contains 50% surfactant paste, 42% water and 8% ethanol.

Process to Make the Coacervate

Premixes

1. Prepare guar premix: combine 3% N-Hance 3196 cationic guar gum powder, and 97% DI water in beaker and mix 30 minutes, reduce the pH to 5-6 with 25% HCL, and mix an additional 15 minutes.
2. Prepare PDMS HIP emulsion: combine 90% 100K cSt PDMS, 2.5% AE1.8S surfactant and 7.5% DI water and mix with speed mixer until emulsified (check dispersion in water to ensure HIP emulsion formation).

Procedure

1. Combine 48.97% PDMS HIP emulsion, 48.53% guar premix and 2.5% AE1.1S in container.
2. Overhead mix with IKA mixer on 800-1000 rpm for 15-30 minutes, or alternately, mix with Speedmixer until smooth.
3. Adjust pH to 7 to 8, if needed.

Antistatic Active 2.0 g SCA powder[1].

[1] SCA are prills of nominally 70% distearyl amine and cumene sulfonic acid ion pair and 30% bis(distearyl)ammonium sulfate with a Rotap median particle size of about 95 microns from Degussa.

Article of Two Compartment Unit Dose PVOH Pouch

88% of the above detergent composition (A) and 12% of the above coacervate composition (C) are combined and mixed into one composition. The detergent and coacervate combination of 56.8 g are placed in one compartment of a water soluble PVOH pouch and 2.0 g of the antistatic active powder in the second compartment of the PVOH pouch. Softness performance testing of this article added into the wash cycle of a laundry process provides significant softness on 100% cotton terry fabrics compared to cotton terry fabrics that are not treated.

Example XXXI

Article of Single Compartment Unit Dose PVOH Pouch

88% of the above detergent composition (A) and 12% of the above coacervate composition (C) are combined and mixed into one composition. The detergent and coacervate combination of 56.8 g are placed into one compartment of a water soluble PVOH pouch.

All documents cited in the Detailed Description of the Invention are, are, in relevant part, incorporated herein by reference; the citation of any document is not to be construed as an admission that it is prior art with respect to the present invention.

It should be understood that every maximum numerical limitation given throughout this specification will include every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

All parts, ratios, and percentages herein, in the Specification, Examples, and Claims, are by weight and all numerical limits are used with the normal degree of accuracy afforded by the art, unless otherwise specified.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed:

1. An article of manufacture comprising:

a. a container comprising a first compartment and a second compartment;

b. a first fabric care composition comprising:

i. a fabric care benefit agent; and ii. a plurality of perfume microcapsules, wherein said first compartment comprises said first fabric care composition; and c. a second fabric care composition comprising a detersive surfactant composition and a perfume, wherein said second compartment comprises said second fabric care composition.

2. The article of claim 1, wherein said container comprises a water soluble film.

3. The article of claim 2, wherein said water soluble film comprises a thickness from about 20 microns to about 80 microns.

4. The article of claim 3, wherein said water soluble film comprises polyvinyl alcohol, hydroxypropyl methyl cellulose, polyethylene oxide, methyl cellulose, non-woven polyvinyl alcohols, polyvinylpyrrolidone, gelatins, or mixtures thereof.

5. The article of claim 4, wherein said first compartment further comprises from about 1 ml to about 5 ml of said first fabric care composition, and wherein said plurality of perfume microcapsules comprises from about 1% to about 4%, by weight of said first fabric care composition.

6. The article of claim 1, wherein said first compartment further comprises from about 0.1 ml to about 30 ml of said first fabric care composition.

7. The article of claim 6, wherein said first compartment further comprises from about 1 ml to about 5 ml of said first fabric care composition.

8. The article of claim 7, wherein said plurality of perfume microcapsules comprises from about 0.1% to about 10% by weight of said first fabric care composition.

9. The article of claim 8, wherein said plurality of perfume microcapsules comprises from about 1% to about 4% by weight of said first fabric care composition.

10. The article of claim 1, wherein said plurality of perfume microcapsules comprise a friable perfume microcapsule.

11. The article of claim 1, wherein said plurality of perfume microcapsules comprise a moisture-activated perfume microcapsule.

12. The article of claim 1, wherein said fabric care benefit agent further comprises silicone, fatty oils, fatty acids, soaps of fatty acids, fatty triglycerides, fatty alcohols, fatty esters, fatty amides, fatty amines, sucrose esters, dispersible polyethylenes, dispersible polyolefins, polymer latexes, clays, or mixtures thereof.

13. The article of claim 1, wherein said first fabric care composition further comprises a static control agent.

* * * * *

UNITED STATES PATENT AND TRADEMARK OFFICE

CERTIFICATE OF CORRECTION

PATENT NO. : 7,528,099 B2
APPLICATION NO. : 11/643236
DATED : May 5, 2009
INVENTOR(S) : Errol Hoffman Wahl et al.

It is certified that error appears in the above-identified patent and that said Letters Patent is hereby corrected as shown below:

Column 7

Line 59, delete "(Velustrole®" and insert -- (Velustrol® --.

Column 16

Line 63, delete "$ROSO_3{}^{31}M^+$" and insert -- $ROSO_3{}^-M^+$ --.

Column 21

Line 16, delete "1to" and insert -- 1% to --.

Line 50, delete "Polyquatemium-6." and insert -- Polyquaternium-6. --.

Column 22

Line 4, delete "Coning" and insert -- Corning --.

Column 31

Line 24, delete "Sipemat®" and insert -- Sipernat® --.

Column 40

Line 57, delete "75.00" and insert -- 15.00 --.

Signed and Sealed this
First Day of November, 2011

David J. Kappos

David J. Kappos
*Director of the United States Patent and Trademark Office*